US007963818B2

(12) United States Patent
Fullerton et al.

(10) Patent No.: US 7,963,818 B2
(45) Date of Patent: Jun. 21, 2011

(54) CORRELATED MAGNETIC TOY PARTS AND METHOD FOR USING THE CORRELATED MAGNETIC TOY PARTS

(75) Inventors: Larry W. Fullerton, New Hope, AL (US); Mark D. Roberts, Huntsville, AL (US)

(73) Assignee: Cedar Ridge Research, LLC., New Hope, AL (US)

( * ) Notice: Subject to any disclaimer, the term of this patent is extended or adjusted under 35 U.S.C. 154(b) by 168 days.

(21) Appl. No.: 12/479,821

(22) Filed: Jun. 7, 2009

(65) Prior Publication Data

US 2009/0288283 A1 Nov. 26, 2009

Related U.S. Application Data

(63) Continuation-in-part of application No. 12/476,952, filed on Jun. 2, 2009.

(51) Int. Cl.
*A63H 33/04* (2006.01)
*H01F 7/20* (2006.01)

(52) U.S. Cl. ..... 446/93; 335/285; 335/306

(58) Field of Classification Search ..... 335/285, 335/306; 446/92

See application file for complete search history.

(56) References Cited

U.S. PATENT DOCUMENTS

| | | | |
|---|---|---|---|
| 381,968 | A | 5/1888 | Tesla |
| 493,858 | A | 3/1893 | Edison |
| 996,933 | A | 7/1911 | Lindquist |
| 1,236,234 | A | 8/1917 | Troje |
| 2,389,298 | A | 11/1945 | Ellis |
| 2,570,625 | A | 10/1951 | Zimmerman et al. |
| 2,722,617 | A | 11/1955 | Cluwen et al. |
| 2,932,545 | A | 4/1960 | Foley |
| 3,005,282 | A | 10/1961 | Christiansen |
| 3,102,314 | A | 9/1963 | Alderfer |
| 3,162,973 | A | 12/1964 | Christiansen |
| 3,208,296 | A | 9/1965 | Baermann |
| 3,242,610 | A | 3/1966 | Christiansen |
| 3,288,511 | A | 11/1966 | Tavano |
| 3,461,601 | A | 8/1969 | Kristiansen |
| 3,468,576 | A | 9/1969 | Beyer et al. |
| 3,474,366 | A | 10/1969 | Barney |
| 3,802,034 | A | 4/1974 | Bookless |
| 4,079,558 | A | 3/1978 | Gorham |
| 4,222,489 | A | 9/1980 | Hutter |
| 4,453,294 | A | 6/1984 | Morita |

(Continued)

FOREIGN PATENT DOCUMENTS

FR 823395 1/1938

(Continued)

OTHER PUBLICATIONS

"BNS Series-Compatible Series AES Safety Controllers"pp. 1-17, http://www.schmersalusa.com/safety_controllers/drawings/aes.pdf (downloaded on or before Jan. 23, 2009).

(Continued)

*Primary Examiner* — Ramon M Barrera
(74) *Attorney, Agent, or Firm* — William J. Tucker

(57) ABSTRACT

A toy is described herein that is made from correlated magnetic toy parts (e.g., toy building blocks) which have an ingenious coupling means that enable the correlated magnetic toy parts to be attached to or released from one another. The correlated magnetic toy parts could have many different shapes and can be attached to one another to form an abstract shaped toy or a predetermined shaped toy.

28 Claims, 18 Drawing Sheets

U.S. PATENT DOCUMENTS

| | | | |
|---|---|---|---|
| 4,547,756 | A | 10/1985 | Miller et al. |
| 4,629,131 | A | 12/1986 | Podell |
| 4,941,236 | A | 7/1990 | Sherman |
| 5,050,276 | A | 9/1991 | Pemberton |
| 5,367,891 | A | 11/1994 | Furuyama |
| 5,383,049 | A | 1/1995 | Carr |
| 5,631,093 | A | 5/1997 | Perry et al. |
| 5,631,618 | A | 5/1997 | Trumper et al. |
| 5,759,081 | A | 6/1998 | Lyman |
| 6,072,251 | A | 6/2000 | Markle |
| 6,170,131 | B1 | 1/2001 | Shin |
| 6,275,778 | B1 | 8/2001 | Shimada et al. |
| 6,457,179 | B1 | 10/2002 | Prendergast |
| 6,607,304 | B1 | 8/2003 | Lake et al. |
| 6,720,698 | B2 | 4/2004 | Galbraith |
| 6,847,134 | B2 | 1/2005 | Frissen et al. |
| 6,862,748 | B2 | 3/2005 | Prendergast |
| 6,927,657 | B1 | 8/2005 | Wu |
| 6,971,147 | B2 | 12/2005 | Halstead |
| 7,066,778 | B2 | 6/2006 | Kretzschmar |
| 7,362,018 | B1 | 4/2008 | Kulogo et al. |
| 7,444,683 | B2 | 11/2008 | Prendergast et al. |
| 2004/0003487 | A1 | 1/2004 | Reiter |
| 2006/0066428 | A1 | 3/2006 | McCarthy et al. |
| 2006/0189259 | A1 | 8/2006 | Park |
| 2006/0290451 | A1 | 12/2006 | Prendergast et al. |
| 2008/0186683 | A1 | 8/2008 | Ligtenberg et al. |
| 2008/0272868 | A1 | 11/2008 | Prendergast et al. |
| 2008/0282517 | A1 | 11/2008 | Claro |

FOREIGN PATENT DOCUMENTS

| | | | |
|---|---|---|---|
| WO | 2007081830 | A2 | 7/2007 |

OTHER PUBLICATIONS

"Magnetic Safety Sensors"pp. 1-3, http://farnell.com/datasheets/6465.pdf (downloaded on or before Jan. 23, 2009).

"Series BNS-B20 Coded-Magnet Sensor Safety Door Handle" pp. 1-2, http://www.schmersalusa.com/catalog_pdfs/BNS_B20.pdf (downloaded on or before Jan. 23, 2009).

"Series BNS333 Coded-Magnet Sensors with Integrated Safety Control Module" pp. 1-2, http://www.schmersalusa.com/machine_guarding/coded_magnet/drawings/bns333.pdf (downloaded on or before Jan. 23, 2009).

FIG. 3B
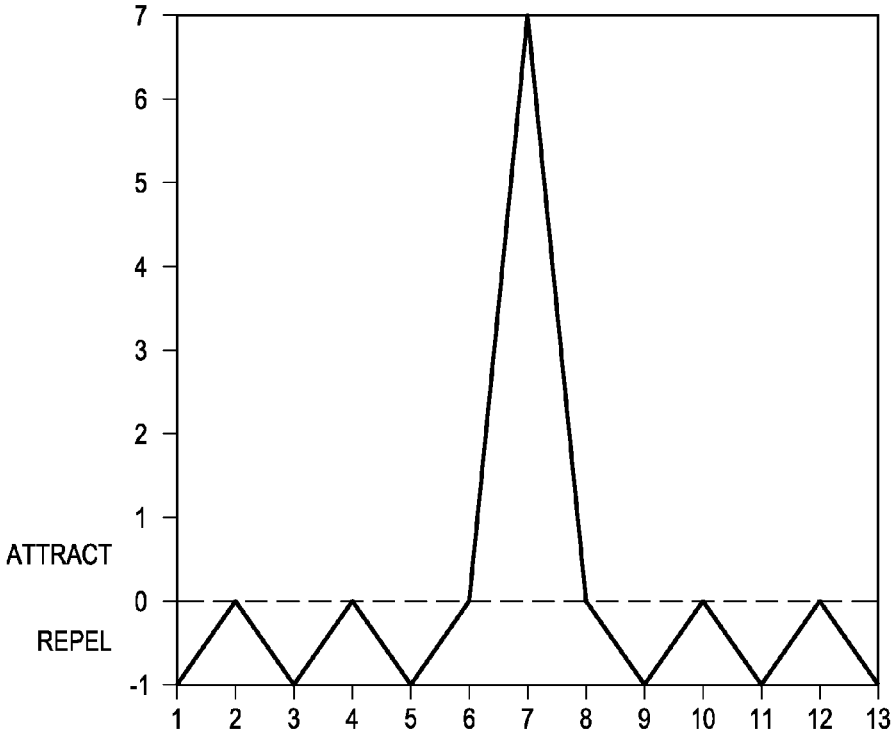
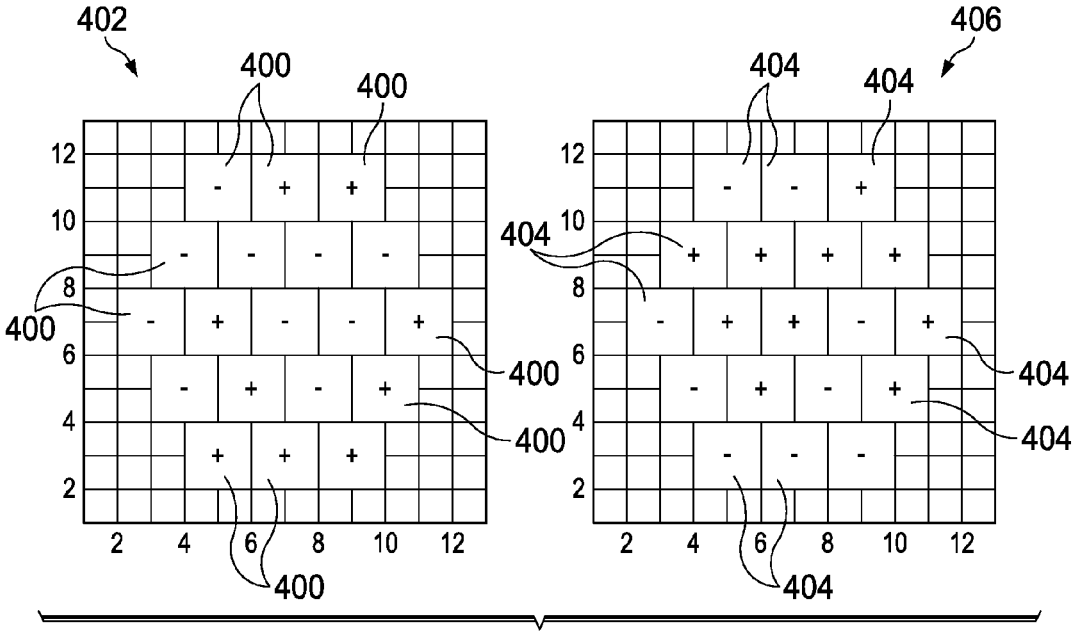
FIG. 4A

FIG. 12A
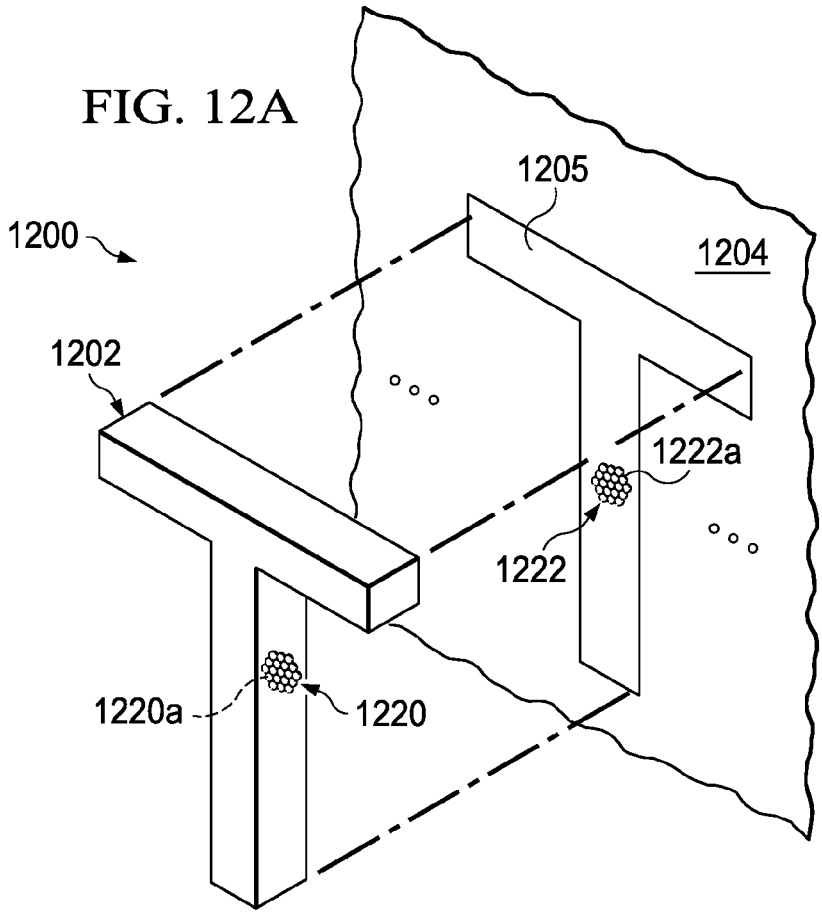
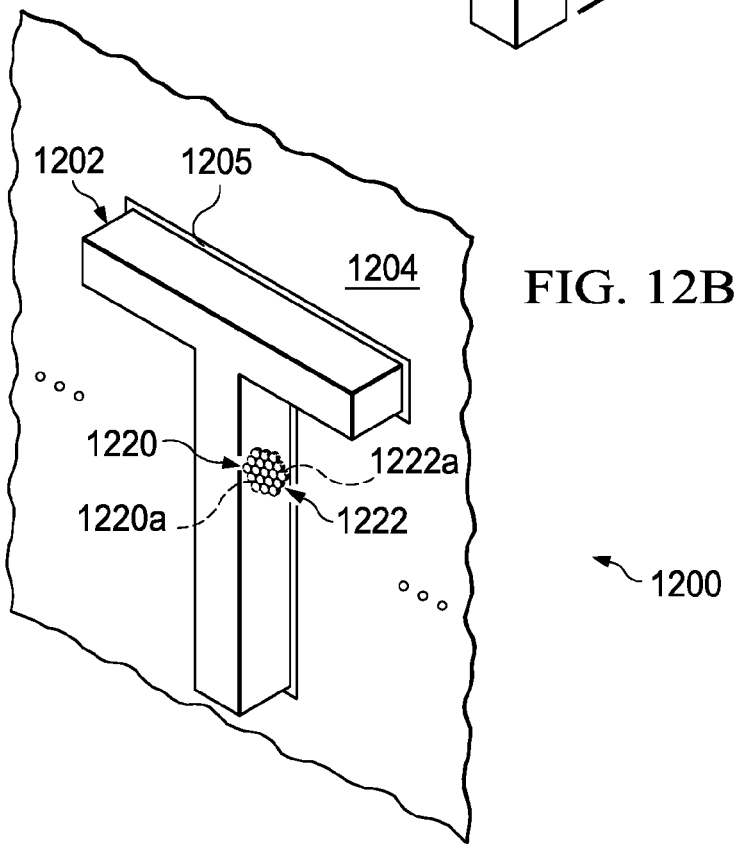
FIG. 12B

CORRELATED MAGNETIC TOY PARTS AND METHOD FOR USING THE CORRELATED MAGNETIC TOY PARTS

CROSS REFERENCE TO RELATED APPLICATIONS

This application is a continuation-in-part application of U.S. patent application Ser. No. 12/476,952 filed on Jun. 2, 2009 and entitled "A Field Emission System and Method", which is a continuation-in-part application of U.S. patent application Ser. No. 12/322,561 filed on Feb. 4, 2009 and entitled "A System and Method for Producing an Electric Pulse", which is a continuation-in-part application of U.S. patent application Ser. No. 12/358,423 filed on Jan. 23, 2009 and entitled "A Field Emission System and Method", which is a continuation-in-part application of U.S. patent application Ser. No. 12/123,718 filed on May 20, 2008 and entitled "A Field Emission System and Method". The contents of these four documents are hereby incorporated herein by reference.

TECHNICAL FIELD

The present invention is related to a toy that is made from multiple correlated magnetic toy parts (e.g., toy building blocks) which have an ingenious coupling means that enable the correlated magnetic toy parts to be attached to or released from one another. The correlated magnetic toy parts could have many different shapes and can be attached to one another to form either an abstract shaped toy or a predetermined shaped toy.

DESCRIPTION OF RELATED ART

Toy manufacturers are constantly trying to develop new toys for children that can challenge the child's imagination yet are not so complex as to frustrate the child in his/her creative endeavors. One such toy is the subject of the present invention.

SUMMARY

In one aspect, the present invention provides a toy which includes a first toy part that incorporates a first field emission structure and a second toy part that incorporates a second field emission structure. The first toy part is attached to the second toy part when the first and second field emission structures are located next to one another and have a certain alignment with respect to one another. The first and second field emission structures each include field emission sources having positions and polarities relating to a desired spatial force function that corresponds to a relative alignment of the first and second field emission structures within a field domain. The first toy part can be released from the second toy part when the first and second field emission structures are turned with respect to one another. In one embodiment, the toy can include multiple toy parts in addition to the first and second toy parts which can be attached to one another to form an abstract shape or a predetermined shape.

In another aspect, the present invention provides a method for enabling a user to form a toy by attaching one or more toy parts to one another by: (a) providing a first toy part that incorporates a first field emission structure; (b) providing a second toy part that incorporates a second field emission structure; and (c) aligning the first toy part with the second toy part such that the first toy part will be attached to the second toy part when the first and second field emission structures are located next to one another and have a certain alignment with respect to one another. The first and second field emission structures each include field emission sources having positions and polarities relating to a desired spatial force function that corresponds to a relative alignment of the first and second field emission structures within a field domain. The first toy part can be released from the second toy part when the first and second field emission structures are turned with respect to one another, in one embodiment, the toy can include multiple toy parts in addition to the first and second toy parts which can be attached to one another to form an abstract shape or a predetermined shape.

Additional aspects of the invention will be set forth, in part, in the detailed description, figures and any claims which follow, and in part will be derived from the detailed description, or can be learned by practice of the invention. It is to be understood that both the foregoing general description and the following detailed description are exemplary and explanatory only and are not restrictive of the invention as disclosed.

BRIEF DESCRIPTION OF THE DRAWINGS

A more complete understanding of the present invention may be obtained by reference to the following detailed description when taken in conjunction with the accompanying drawings wherein:

FIGS. 12A-12C are diagrams of an exemplary toy which includes one or more correlated magnetic toy parts (shaped like letter(s), number(s), animal(s), etc. . . . ) which are configured to be attached to and released from an another correlated magnetic toy part (shaped like a game board) in accordance with an embodiment of the present invention.

DETAILED DESCRIPTION

The present invention includes a toy made from toy parts (e.g., toy building blocks) that incorporate correlated magnets which provide an ingenious coupling means that enable the toy parts to be attached to and released from one another. The toy parts could have many different shapes and can be attached to one another to form an abstract shape or a predetermined shape. The toy parts of the present invention are made possible, in part, by the use of an emerging, revolutionary technology that is called correlated magnetics.

This revolutionary technology referred to herein as correlated magnetics was first fully described and enabled in the co-assigned U.S. patent application Ser. No. 12/123,718 filed on May 20, 2008 and entitled "A Field Emission System and Method". The contents of this document are hereby incorporated herein by reference. A second generation of a correlated magnetic technology is described and enabled in the co-assigned U.S. patent application Ser. No. 12/358,423 filed on Jan. 23, 2009 and entitled "A Field Emission System and Method". The contents of this document are hereby incorporated herein by reference. A third generation of a correlated magnetic technology is described and enabled in the co-assigned U.S. patent application Ser. No. 12/476,952 filed on Jun. 2, 2009 and entitled "A Field Emission System and Method". The contents of this document are hereby incorporated herein by reference. Another technology known as correlated inductance, which is related to correlated magnetics, has been described and enabled in the co-assigned U.S. patent application Ser. No. 12/322,561 filed on Feb. 4, 2009 and entitled "A System and Method for Producing and Electric Pulse". The contents of this document are hereby incorporated herein by reference. A brief discussion about correlated magnetics is provided first before a detailed discussion is provided about the correlated magnetic toy.

Correlated Magnetics Technology

This section is provided to introduce the reader to basic magnets and the new and revolutionary correlated magnetic technology. This section includes subsections relating to basic magnets, correlated magnets, and correlated electromagnetics. It should be understood that this section is provided to assist the reader with understanding the present invention, and should not be used to limit the scope of the present invention.

A. Magnets

Figure 1:
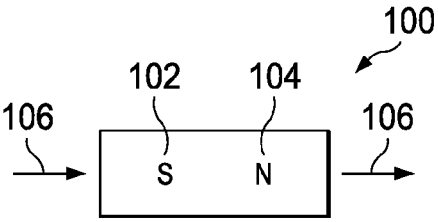
FIGS. 1-9 are various diagrams used to help explain different concepts about correlated magnetic technology which can be utilized in an embodiment of the present invention.

A magnet is a material or object that produces a magnetic field which is a vector field that has a direction and a magnitude (also called strength). Referring to FIG. 1, there is illustrated an exemplary magnet 100 which has a South pole 102 and a North pole 104 and magnetic field vectors 106 that represent the direction and magnitude of the magnet's moment. The magnet's moment is a vector that characterizes the overall magnetic properties of the magnet 100. For a bar magnet, the direction of the magnetic moment points from the South pole 102 to the North pole 104. The North and South poles 104 and 102 are also referred to herein as positive (+) and negative (−) poles, respectively.

Figure 2A:
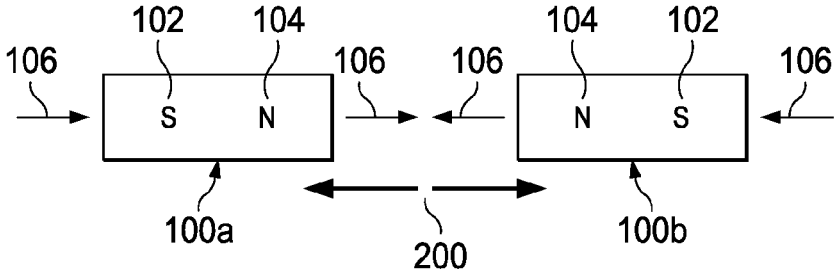
Figure 2B:
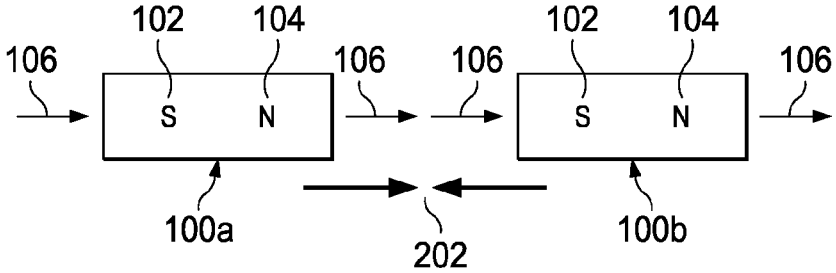
Figure 2C:
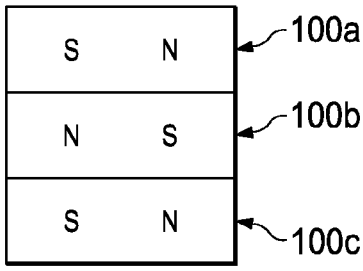

Referring to FIG. 2A, there is a diagram that depicts two magnets 100*a* and 100*b* aligned such that their polarities are opposite in direction resulting in a repelling spatial force 200 which causes the two magnets 100*a* and 100*b* to repel each other. In contrast, FIG. 2B is a diagram that depicts two magnets 100*a* and 100*b* aligned such that their polarities are in the same direction resulting in an attracting spatial force 202 which causes the two magnets 100*a* and 100*b* to attract each other. In FIG. 2B, the magnets 100*a* and 100*b* are shown as being aliened with one another but they can also be partially aligned with one another where they could still "stick" to each other and maintain their positions relative to each other. FIG. 2C is a diagram that illustrates how magnets 100*a*, 100*b* and 100*c* will naturally stack on one another such that their poles alternate.

B. Correlated Magnets

Correlated magnets can be created in a wide variety of ways depending on the particular application as described in the aforementioned U.S. patent application Ser. Nos. 12/123,718, 12/358,432, and 12/476,952 by using a unique combination of magnet arrays (referred to herein as magnetic field emission sources), correlation theory (commonly associated with probability theory and statistics) and coding theory (commonly associated with communication systems). A brief discussion is provided next to explain how these widely diverse technologies are used in a unique and novel way to create correlated magnets.

Basically, correlated magnets are made from a combination of magnetic (or electric) field emission sources which have been configured in accordance with a pre-selected code having desirable correlation properties. Thus, when a magnetic field emission structure is brought into alignment with a complementary, or mirror image, magnetic field emission structure the various magnetic field emission sources will all align causing a peak spatial attraction force to be produced, while the misalignment of the magnetic field emission structures cause the various magnetic field emission sources to substantially cancel each other out in a manner that is a function of the particular code used to design the two magnetic field emission structures. In contrast, when a magnetic field emission structure is brought into alignment with a duplicate magnetic field emission structure then the various magnetic field emission sources all align causing a peak spatial repelling force to be produced, while the misalignment of the magnetic field emission structures causes the various magnetic field emission sources to substantially cancel each other out in a manner that is a function of the particular code used to design the two magnetic field emission structures.

The aforementioned spatial forces (attraction, repelling) have a magnitude that is a function of the relative alignment of two magnetic field emission structures and their corresponding spatial force (or correlation) function, the spacing (or distance) between the two magnetic field emission structures, and the magnetic field strengths and polarities of the various sources making up the two magnetic field emission structures. The spatial force functions can be used to achieve precision alignment and precision positioning not possible with basic magnets. Moreover, the spatial force functions can enable the precise control of magnetic fields and associated spatial forces thereby enabling new forms of attachment devices for attaching objects with precise alignment and new systems and methods for controlling precision movement of objects. An additional unique characteristic associated with correlated magnets relates to the situation where the various magnetic field sources making-up two magnetic field emission structures can effectively cancel out each other when they are brought out of alignment which is described herein as a release force. This release force is a direct result of the particular correlation coding used to configure the magnetic field emission structures.

A person skilled in the art of coding theory will recognize that there are many different types of codes that have different correlation properties which have been used in communications for channelization purposes, energy spreading, modulation, and other purposes. Many of the basic characteristics of such codes make them applicable for use in producing the magnetic field emission structures described herein. For example. Barker codes are known for their autocorrelation properties and can be used to help configure correlated magnets. Although, a Barker code is used in an example below with respect to FIGS. 3A-3B, other forms of codes which may or may not be well known in the art are also applicable to correlated magnets because of their autocorrelation, cross-correlation, or other properties including, for example. Gold codes, Kasami sequences, hyperbolic congruential codes, quadratic congruential codes, linear congruential codes, Welch-Costas array codes, Golomb-Costas array codes, pseudorandom codes, chaotic codes. Optimal Golomb Ruler codes, deterministic codes, designed codes, one dimensional codes, two dimensional codes, three dimensional codes, or four dimensional codes, combinations thereof, and so forth.

Figure 3A:
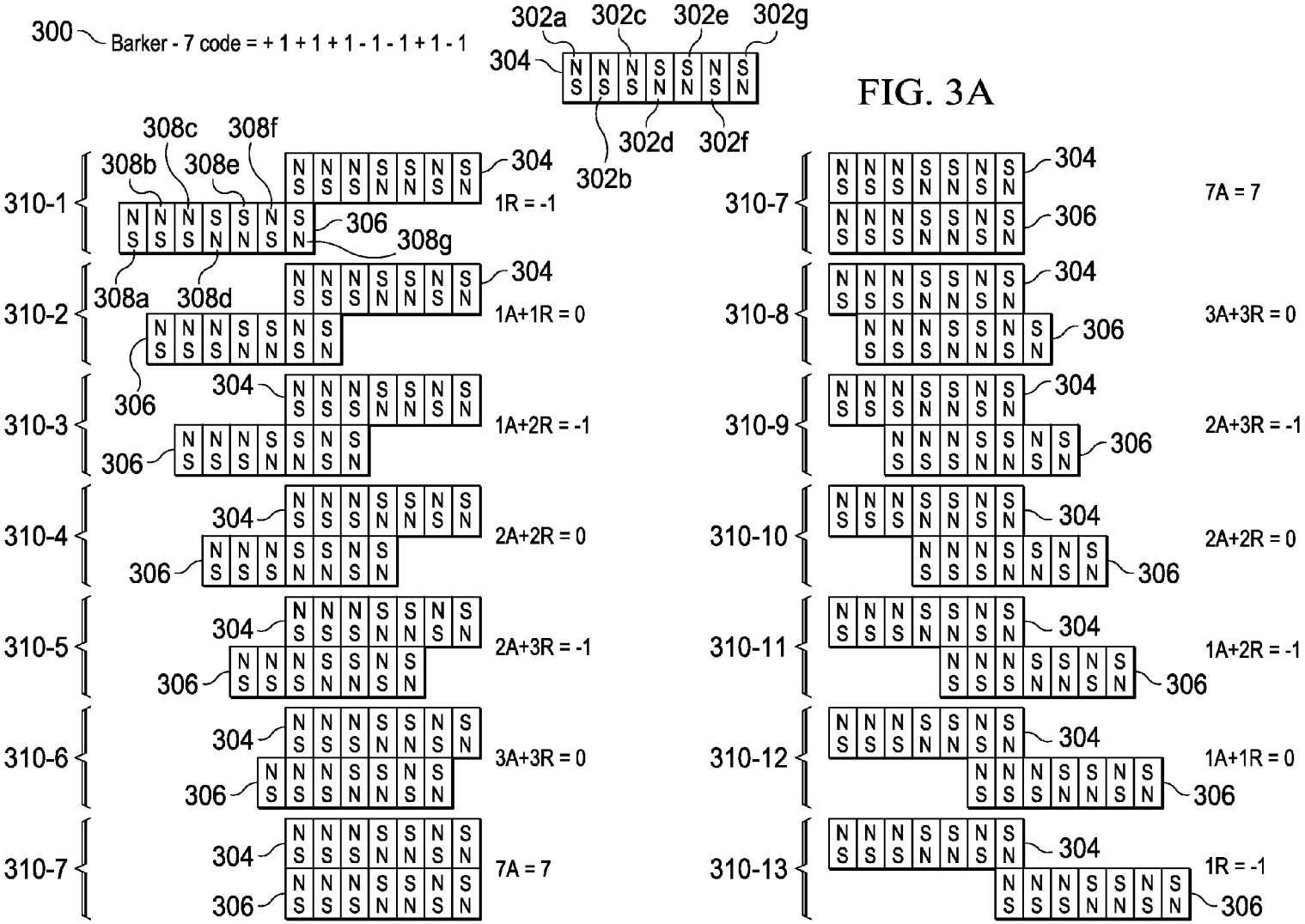

Referring to FIG. 3A, there are diagrams used to explain how a Barker length 7 code 300 can be used to determine polarities and positions of magnets 302*a*, 302*b* . . . 302*g* making up a first magnetic field emission structure 304. Each magnet 302*a*, 302*b* . . . 302*g* has the same or substantially the same magnetic field strength (or amplitude), which for the sake of this example is provided as a unit of 1 (where A=Attract, R=Repel, A=−R, A=1, R=−1). A second magnetic field emission structure 306 (including magnets 308*a*, 308*b* . . . 308*g*) that is identical to the first magnetic field emission structure 304 is shown in 13 different alignments 310-1 through 310-13 relative to the first magnetic field emission structure 304. For each relative alignment, the number of magnets that repel plus the number of magnets that attract is calculated, where each alignment has a spatial force in accordance with a spatial force function based upon the correlation function and magnetic field strengths of the magnets 302*a*, 302*b* . . . 302*g* and 308*a*, 308*b* . . . 308*g*. With the specific Barker code used, the spatial force varies from −1 to 7, where the peak occurs when the two magnetic field emission structures 304 and 306 are aligned which occurs when their respective codes are aligned. The off peak spatial force, referred to as a side lobe force, varies from 0 to −1. As such, the spatial force function causes the magnetic field emission structures 304 and 306 to generally repel each other unless they are aligned such that each of their magnets are correlated with a complementary magnet (i.e., a magnet's South pole aligns with another magnet's North pole, or vice versa), in other words, the two magnetic field emission structures 304 and 306 substantially correlate with one another when they are aligned to substantially mirror each other.

In FIG. 3B, there is a plot that depicts the spatial force function of the two magnetic field emission structures 304 and 306 which results from the binary autocorrelation function of the Barker length 7 code 300, where the values at each alignment position 1 through 13 correspond to the spatial force values that were calculated for the thirteen alignment positions 310-1 through 310-13 between the two magnetic field emission structures 304 and 306 depicted in FIG. 3A. As the true autocorrelation function for correlated magnet field structures is repulsive, and most of the uses envisioned will have attractive correlation peaks, the usage of the term 'autocorrelation' herein will refer to complementary correlation unless otherwise stated. That is, the interacting faces of two such correlated magnetic field emission structures 304 and 306 will be complementary to (i.e., mirror images of) each other. This complementary autocorrelation relationship can be seen in FIG. 3A where the bottom face of the first magnetic field emission structure 304 having the pattern 'S S S N N S N' is shown interacting with the top face of the second magnetic field emission structure 306 having the pattern 'N N N S S N S', which is the mirror image (pattern) of the bottom face of the first magnetic field emission structure 304.

Figure 4B:
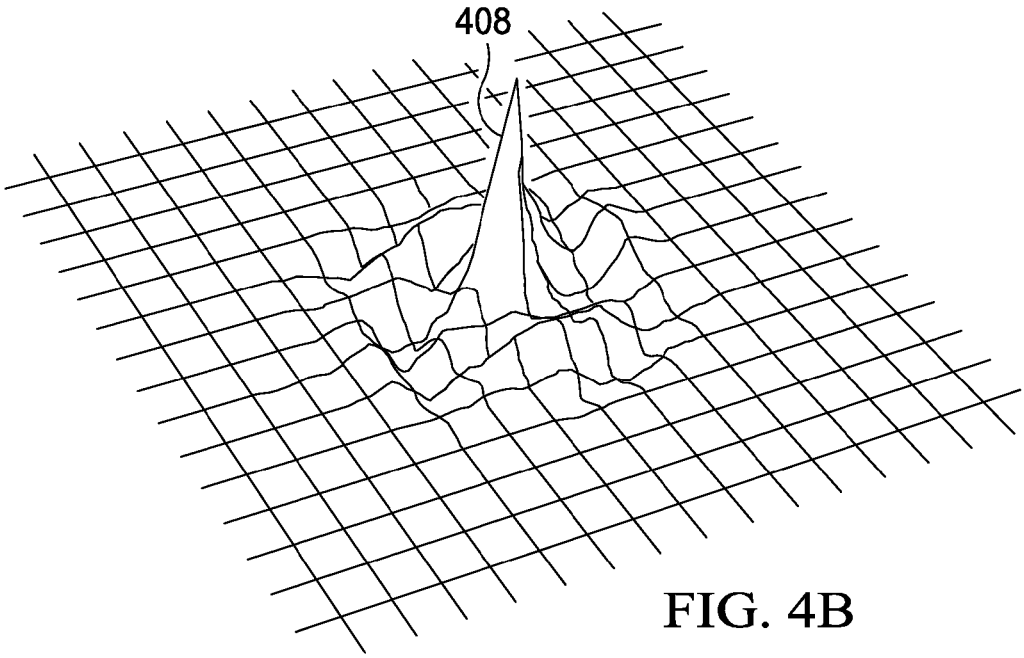
Figure 4C:
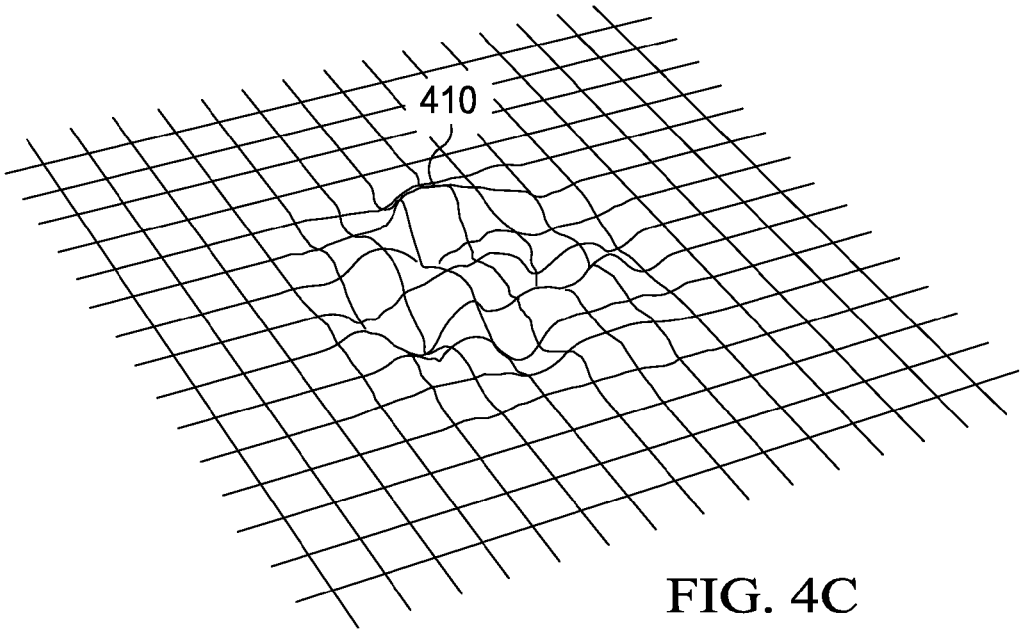

Referring to FIG. 4A, there is a diagram of an array of 19 magnets 400 positioned in accordance with an exemplary code to produce an exemplary magnetic field emission structure 402 and another array of 19 magnets 404 which is used to produce a mirror image magnetic field emission structure 406. In this example, the exemplary code was intended to produce the first magnetic field emission structure 402 to have a first stronger lock when aligned with its mirror image magnetic field emission structure 406 and a second weaker lock when it is rotated 90° relative to its mirror image magnetic field emission structure 406. FIG. 48 depicts a spatial force function 408 of the magnetic field emission structure 402 interacting with its mirror image magnetic field emission structure 406 to produce the first stronger lock. As can be seen, the spatial force function 408 has a peak which occurs when the two magnetic field emission structures 402 and 406 are substantially aligned. FIG. 4C depicts a spatial force function 410 of the magnetic field emission structure 402 interacting with its mirror magnetic field emission structure 406 after being rotated 90°. As can be seen, the spatial force function 410 has a smaller peak which occurs when the two magnetic field emission structures 402 and 406 are substantially aligned but one structure is rotated 90°. If the two magnetic field emission structures 402 and 406 are in other positions then they could be easily separated.

Figure 5:
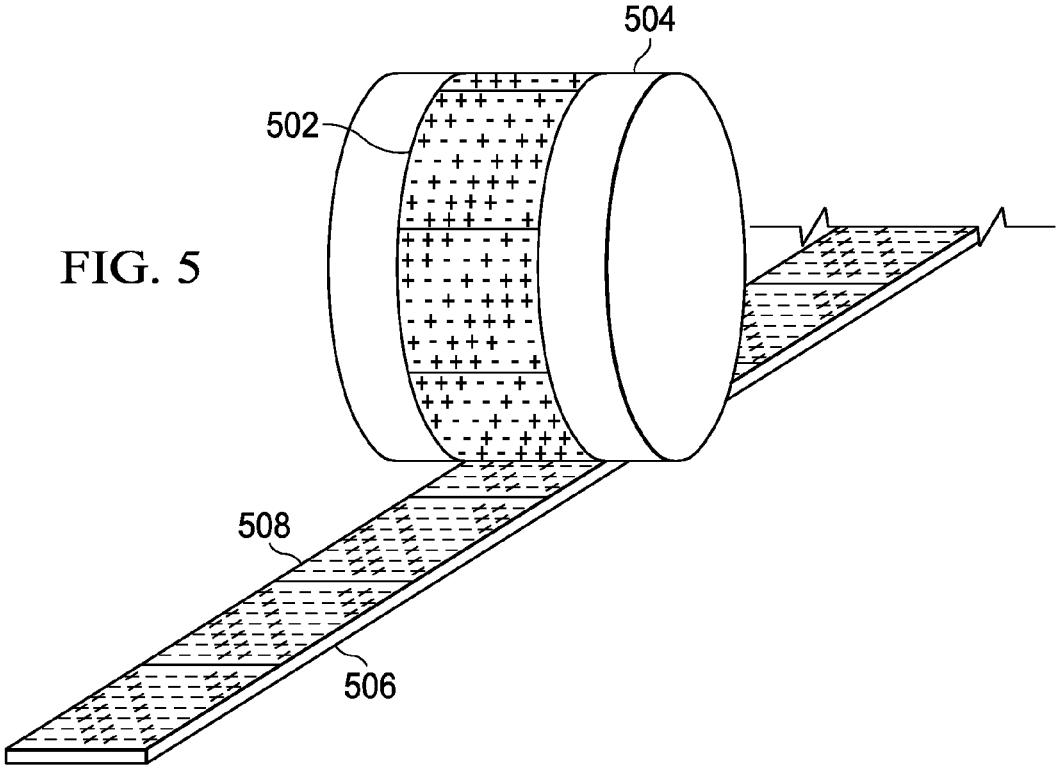

Referring to FIG. 5, there is a diagram depicting a correlating magnet surface 502 being wrapped back on itself on a cylinder 504 (or disc 504, wheel 504) and a conveyor belt/tracked structure 506 having located thereon a mirror image correlating magnet surface 508. In this case, the cylinder 504 can be turned clockwise or counter-clockwise by some force so as to roll along the conveyor belt/tracked structure 506. The fixed magnetic field emission structures 502 and 508 provide a traction and gripping (i.e., holding) force as the cylinder 504 is turned by some other mechanism (e.g., a motor). The gripping force would remain substantially constant as the cylinder 504 moved down the conveyor belt/tracked structure 506 independent of friction or gravity and could therefore be used to move an object about a track that moved up a wall, across a ceiling, or in any other desired direction within the limits of the gravitational force (as a function of the weight of the object) overcoming the spatial force of the aligning magnetic field emission structures 502 and 508. If desired, this cylinder 504 (or other rotary devices) can also be operated against other rotary correlating surfaces to provide a gear-like operation. Since the hold-down force equals the traction force, these gears can be loosely connected and still give positive, non-slipping rotational accuracy. Plus, the magnetic field emission structures 502 and 508 can have surfaces which are perfectly smooth and still provide positive, non-slip traction. In contrast to legacy friction-based wheels, the traction force provided by the magnetic field emission structures 502 and 508 is largely independent of the friction forces between the traction wheel and the traction surface and can be employed with low friction surfaces. Devices moving about based on magnetic traction can be operated independently of gravity for example in weightless conditions including space, underwater, vertical surfaces and even upside down.

Figure 6:
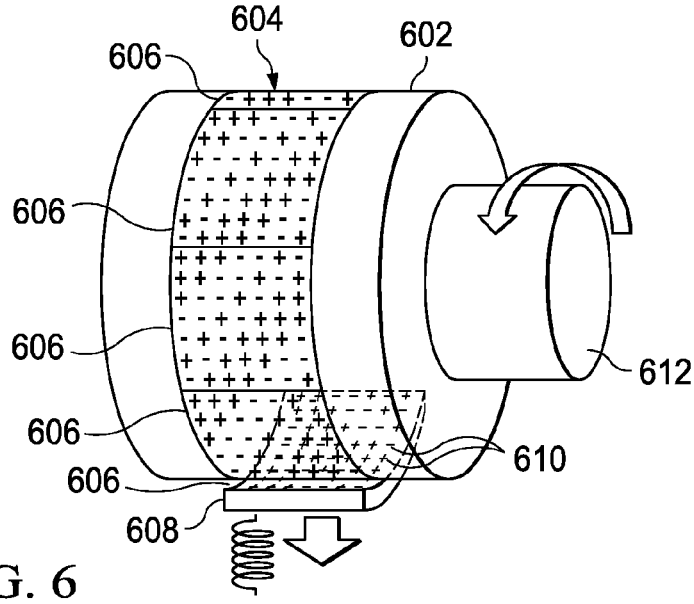

Referring to FIG. 6, there is a diagram depicting an exemplary cylinder 602 having wrapped thereon a first magnetic field emission structure 604 with a code pattern 606 that is repeated six times around the outside of the cylinder 602. Beneath the cylinder 602 is an object 608 having a curved surface with a slightly larger curvature than the cylinder 602 and having a second magnetic field emission structure 610 that is also coded using the code pattern 606. Assume, the cylinder 602 is turned at a rotational rate of 1 rotation per second by shaft 612. Thus, as the cylinder 602 turns, six times a second the first magnetic field emission structure 604 on the cylinder 602 aligns with the second magnetic field emission structure 610 on the object 608 causing the object 608 to be repelled (i.e., moved downward) by the peak spatial force function of the two magnetic field emission structures 604 and 610. Similarly, had the second magnetic field emission structure 610 been coded using a code pattern that mirrored code pattern 606, then 6 times a second the first magnetic field emission structure 604 of the cylinder 602 would align with the second magnetic field emission structure 610 of the object 608 causing the object 608 to be attracted (i.e., moved upward) by the peak spatial force function of the two magnetic field emission structures 604 and 610. Thus, the movement of the cylinder 602 and the corresponding first magnetic field emission structure 604 can be used to control the movement of the object 608 having its corresponding second magnetic field emission structure 610. One skilled in the art will recognize that the cylinder 602 may be connected to a shaft 612 which may be turned as a result of wind turning a windmill, a water wheel or turbine, ocean wave movement, and other methods whereby movement of the object 608 can result from some source of energy scavenging. As such, correlated magnets enables the spatial forces between objects to be precisely controlled in accordance with their movement and also enables the movement of objects to be precisely controlled in accordance with such spatial forces.

In the above examples, the correlated magnets 304, 306, 402, 406, 502, 508, 604 and 610 overcome the normal 'magnet orientation' behavior with the aid of a holding mechanism such as an adhesive, a screw, a bolt & nut, etc. . . . In other cases, magnets of the same magnetic field emission structure could be sparsely separated from other magnets (e.g., in a sparse array) such that the magnetic forces of the individual magnets do not substantially interact, in which case the polarity of individual magnets can be varied in accordance with a code without requiring a holding mechanism to prevent magnetic forces from 'flipping' a magnet. However, magnets are typically close enough to one another such that their magnetic forces would substantially interact to cause at least one of them to 'flip' so that their moment vectors align but these magnets can be made to remain in a desired orientation by use of a holding mechanism such as an adhesive, a screw, a bolt & nut, etc. . . . As such, correlated magnets often utilize some sort of holding mechanism to form different magnetic field emission structures which can be used in a wide-variety of applications like, for example, a turning mechanism, a tool insertion slot, alignment marks, a latch mechanism, a pivot mechanism, a swivel mechanism, a lever, a drill head assembly, a hole cutting tool assembly, a machine press tool, a gripping apparatus, a slip ring mechanism, and a structural assembly.

C. Correlated Electromagnetics

Correlated magnets can entail the use of electromagnets which is a type of magnet in which the magnetic field is produced by the flow of an electric current. The polarity of the magnetic field is determined by the direction of the electric current and the magnetic field disappears when the current ceases. Following are a couple of examples in which arrays of electromagnets are used to produce a first magnetic field emission structure that is moved over time relative to a second magnetic field emission structure which is associated with an object thereby causing the object to move.

Figure 7:
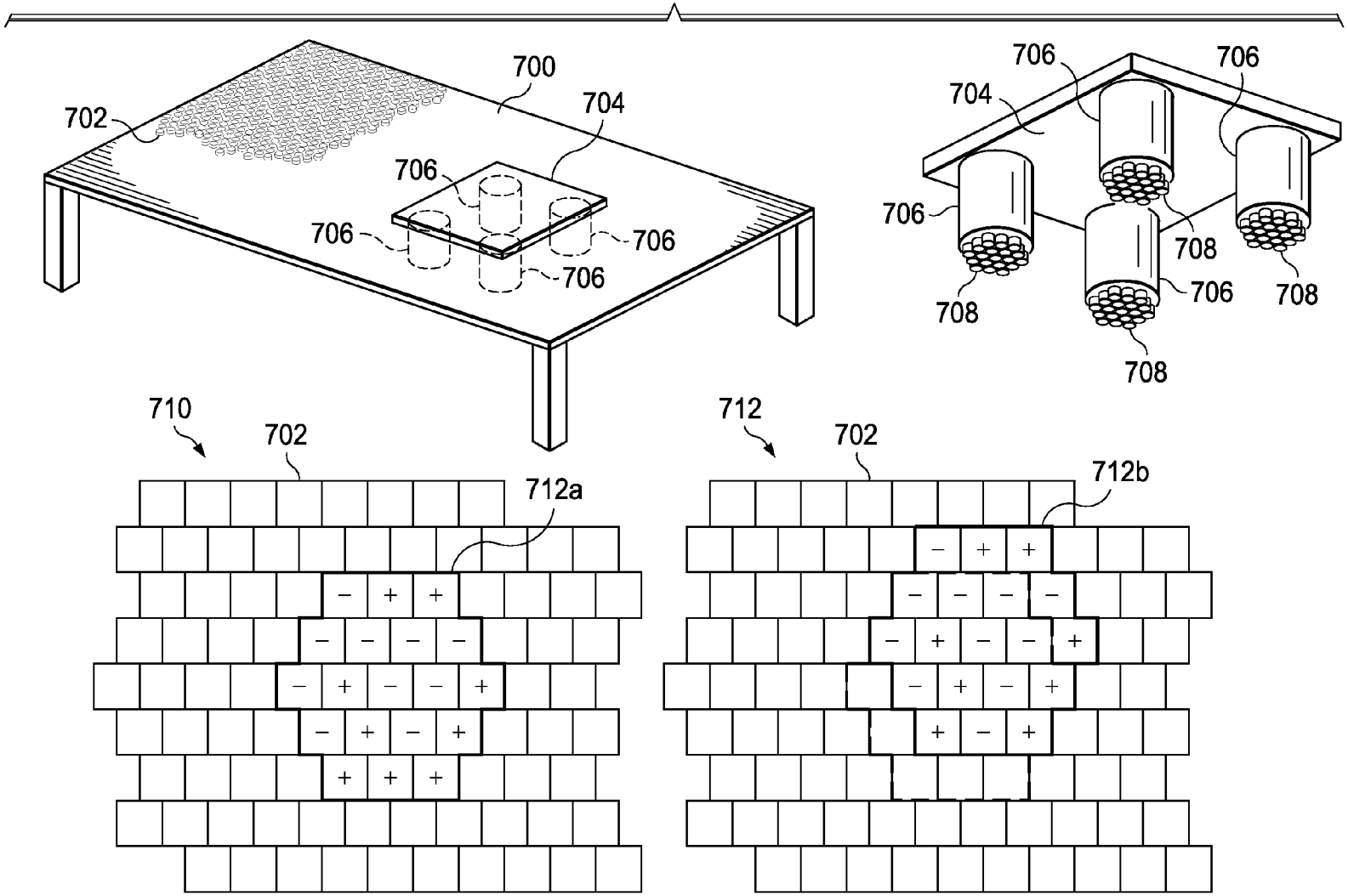

Referring to FIG. 7, there are several diagrams used to explain a 2-D correlated electromagnetics example in which there is a table 700 having a two-dimensional electromagnetic array 702 (first magnetic field emission structure 702) beneath its surface and a movement platform 704 having at least one table contact member 706. In this example, the movement platform 704 is shown having four table contact members 706 each having a magnetic field emission structure 708 (second magnetic field emission structures 708) that would be attracted by the electromagnetic array 702. Computerized control of the states of individual electromagnets of the electromagnet array 702 determines whether they are on or off and determines their polarity. A first example 710 depicts states of the electromagnetic array 702 configured to cause one of the table contact members 706 to attract to a subset 712*a* of the electromagnets within the magnetic field emission structure 702. A second example 712 depicts different states of the electromagnetic array 702 configured to cause the one table contact member 706 to be attracted (i.e., move) to a different subset 712*b* of the electromagnets within the field emission structure 702. Per the two examples, one skilled in the art can recognize that the table contact member(s) 706 can be moved about table 700 by varying the states of the electromagnets of the electromagnetic array 702.

Figure 8:
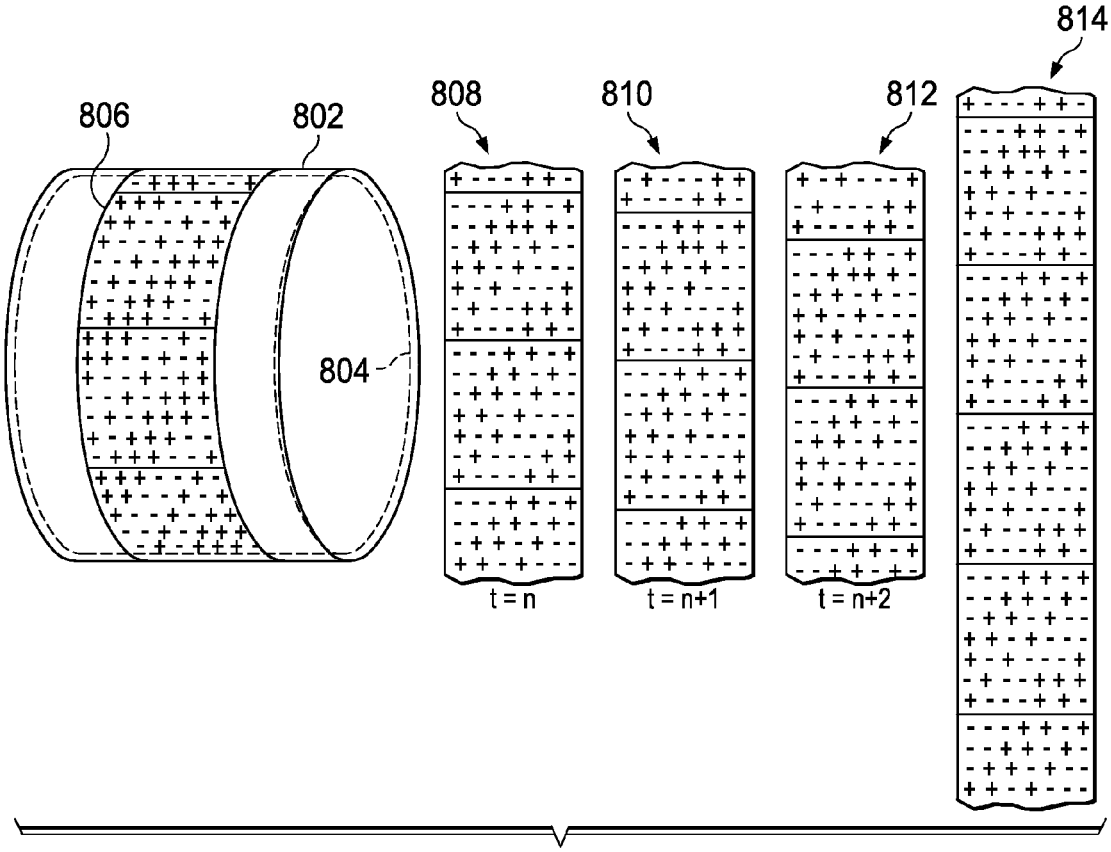

Referring to FIG. 8, there are several diagrams used to explain a 3-D correlated electromagnetics example where there is a first cylinder 802 which is slightly larger than a second cylinder 804 that is contained inside the first cylinder 802. A magnetic field emission structure 806 is placed around the first cylinder 802 (or optionally around the second cylinder 804). An array of electromagnets (not shown) is associated with the second cylinder 804 (or optionally the first cylinder 802) and their states are controlled to create a moving mirror image magnetic field emission structure to which the magnetic field emission structure 806 is attracted so as to cause the first cylinder 802 (or optionally the second cylinder 804) to rotate relative to the second cylinder 804 (or optionally the first cylinder 802). The magnetic field emission structures 808, 810, and 812 produced by the electromagnetic array on the second cylinder 804 at time t=n, t=n+1, and t=n+2, show a pattern mirroring that of the magnetic field emission structure 806 around the first cylinder 802. The pattern is shown moving downward in time so as to cause the first cylinder 802 to rotate counterclockwise. As such, the speed and direction of movement of the first cylinder 802 (or the second cylinder 804) can be controlled via state changes of the electromagnets making up the electromagnetic array. Also depicted in FIG. 8 there is an electromagnetic array 814 that corresponds to a track that can be placed on a surface such that a moving mirror image magnetic field emission structure can be used to move the first cylinder 802 backward or forward on the track using the same code shift approach shown with magnetic field emission structures 808, 810, and 812 (compare to FIG. 5).

Figure 9:
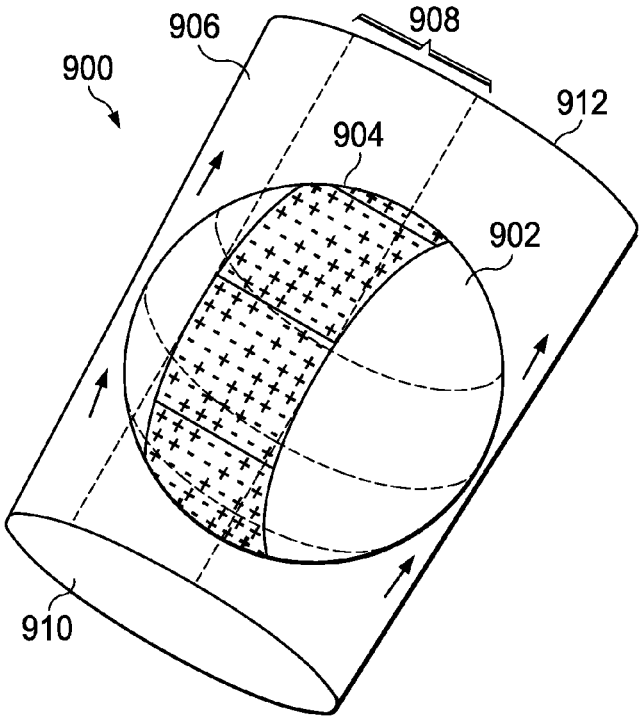

Referring to FIG. 9, there is illustrated an exemplary valve mechanism 900 based upon a sphere 902 (having a magnetic field emission structure 904 wrapped thereon) which is located in a cylinder 906 (having an electromagnetic field emission structure 908 located thereon). In this example, the electromagnetic field emission structure 908 can be varied to move the sphere 902 upward or downward in the cylinder 906 which has a first opening 910 with a circumference less than or equal to that of the sphere 902 and a second opening 912 having a circumference greater than the sphere 902. This configuration is desirable since one can control the movement of the sphere 902 within the cylinder 906 to control the flow rate of a gas or liquid through the valve mechanism 900. Similarly, the valve mechanism 900 can be used as a pressure control valve. Furthermore, the ability to move an object within another object having a decreasing size enables various types of sealing mechanisms that can be used for the sealing of windows, refrigerators, freezers, food storage containers, boat hatches, submarine hatches, etc., where the amount of sealing force can be precisely controlled. One skilled in the art will recognize that many different types of seal mechanisms that include gaskets, o-rings, and the like can be employed with the use of the correlated magnets. Plus, one skilled in the art will recognize that the magnetic field emission structures can have an array of sources including, for example, a permanent magnet, an electromagnet, an electret, a magnetized ferromagnetic material, a portion of a magnetized ferromagnetic material, a soft magnetic material, or a superconductive magnetic material, some combination thereof, and so forth.

Correlated Magnetic Toy

Figure 10A:
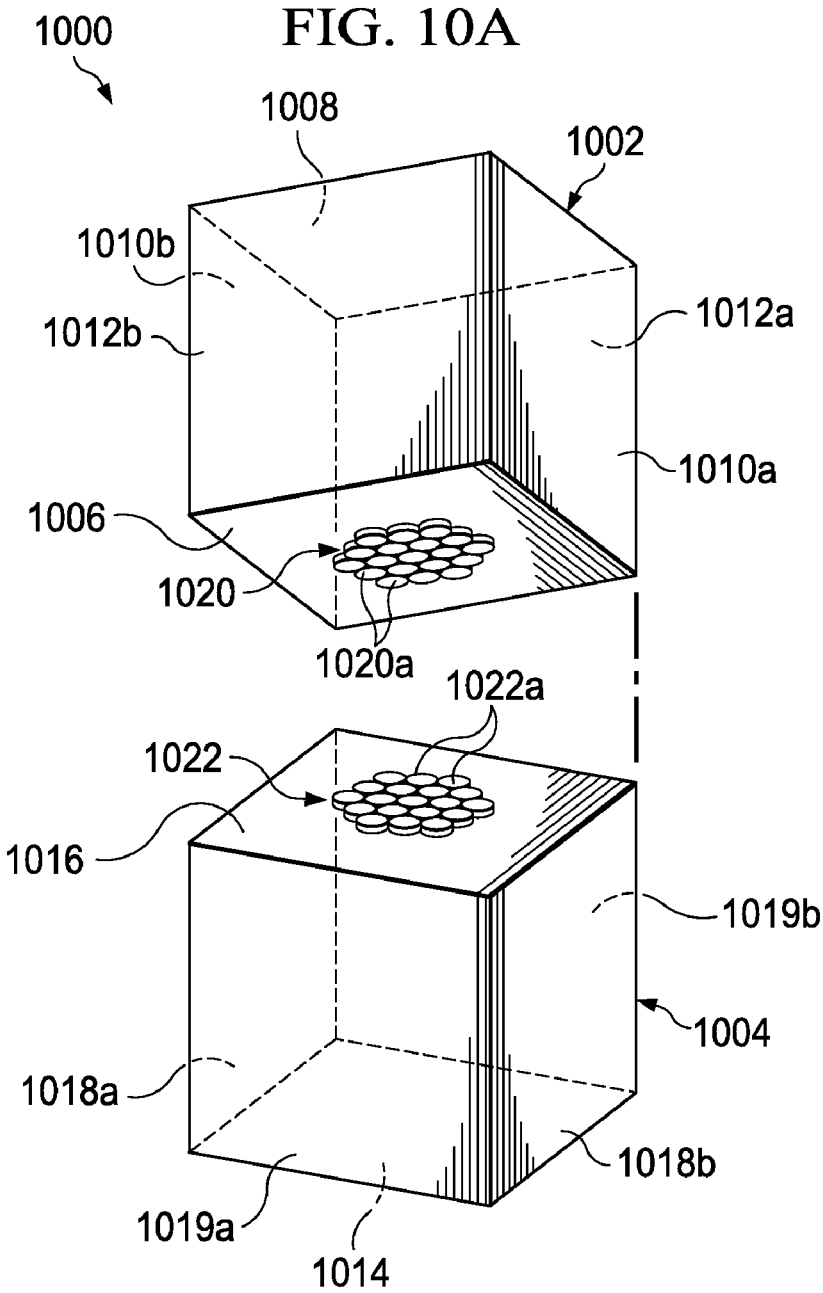
FIGS. 10A-10B are diagrams of an exemplary toy that includes a first correlated magnetic toy part and a second correlated magnetic toy part in accordance with an embodiment of the present invention.
Figure 10B:
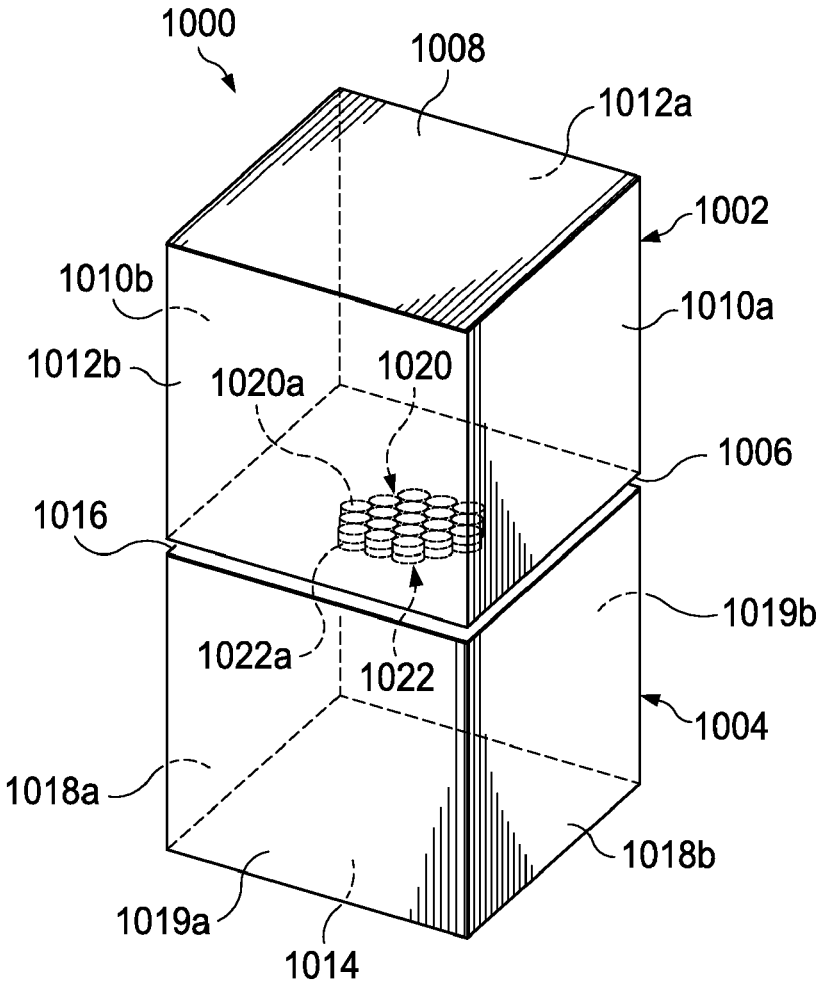

Referring to FIGS. 10A-10B, there are diagrams of an exemplary correlated magnetic toy 100 that includes a first toy part 1002 which can be attached to and released from a second toy part 1004 in accordance with an embodiment of the present invention. In this example, the first toy part 1002 (first toy building element 1002) is shaped like a block that has a bottom wall 1006, a top wall 1008, opposite side walls 1010*a* and 1010*b*, and opposite end walls 1012*a* and 1012*b*. Likewise, the second toy part 1004 (second toy building element 1004) is shaped like a block that has a bottom wall 1014, a top wall 1016, opposite side walls 1018*a* and 1018*b*, and opposite end walls 1019*a* and 1019*b*.

The first toy part 1002 has a first field emission structure 1020 (more possible) incorporated within the bottom wall 1006 (or other wall)(see FIG. 10A). In this example, the first field emission structure 1020 is shown extending out from the bottom wall 1006. Alternatively, the first field emission structure 1020 could be flush with the bottom wall 1006 or the first field emission structure 1020 could be recessed within the first toy part 1002 such that it is not visible. The second toy part 1004 has a second field emission structure 1022 (more possible) incorporated within the top wall 1016 (or other wall)(see FIG. 10A). In this example, the second field emission structure 1022 is shown extending out from the top wall 1016. Alternatively, the second field emission structure 1022 could be flush with the top wall 1016 or the second field emission structure 1022 could be recessed within the second toy part 1004 such that it is not visible. Moreover, the first and second field emission structures 1020 and 1022 depicted in FIG. 10A and in other drawings associated with other exemplary correlated magnetic toys are themselves exemplary. Generally, the field emission structures 1020 and 1022 could have many different configurations and could be many different types including those comprising permanent magnets, electromagnets, and/or electro-permanent magnets where their size, shape, source strengths, coding, and other characteristics can be tailored to meet different correlated magnetic toy requirements.

Referring again to FIG. 10A, the first magnetic field emission structure 1020 is configured to interact (correlate) with the second magnetic field emission structure 1022 such that the first toy part 1002 can, when desired, be substantially aligned to become attached (secured) to the second toy part 1004 or misaligned to become removed (detached) from the second toy part 1004. In particular, the first toy part 1002 can be attached to the second toy part 1004 when their respective first and second magnetic field emission structures 1020 and 1022 are located next to one another and have a certain alignment with respect to one another (see FIG. 10B). Under one arrangement, the first toy part 1002 is attached to the second toy part 1004 with a desired strength to prevent the first toy part 1002 from being inadvertently disengaged from the second toy part 1004. The first toy part 1002 can be released from the second toy part 1004 when their respective first and second magnetic field emission structures 1020 and 1022 are turned with respect to one another. This is all possible because the first and second magnetic field emission structures 1020 and 1022 each comprise an array of field emission sources 1020*a* and 1022*a* (e.g., an array of magnets 1020*a* and 1022*a*) each having positions and polarities relating to a desired spatial force function that corresponds to a relative alignment of the first and second magnetic field emission structures 1020 and 1022 within a field domain (see discussion about correlated magnet technology). An example of how the first toy part 1002 can be attached (secured) to or removed from the second toy part 1004 is discussed in detail below with respect to FIGS. 11A-11I.

Figure 11A:
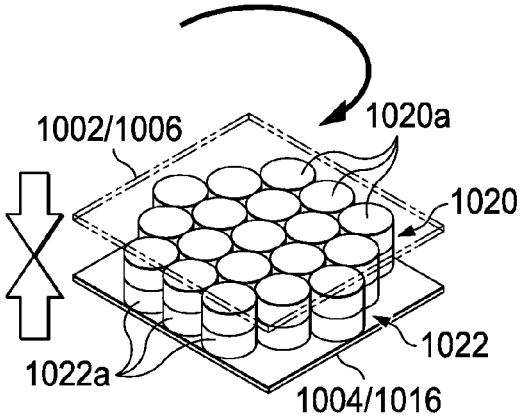
FIGS. 11A-11I are several diagrams that illustrate a portion of the first correlated magnetic toy part and the second correlated magnetic toy part which are used to show how an exemplary first magnetic field emission structure (attached to the first toy part) and its mirror image second magnetic field emission structure (attached to the second toy part) can be aligned or misaligned relative to each other to enable one to secure or remove the first toy part to or from the second toy part in accordance with an embodiment of the present invention.
Figure 11B:
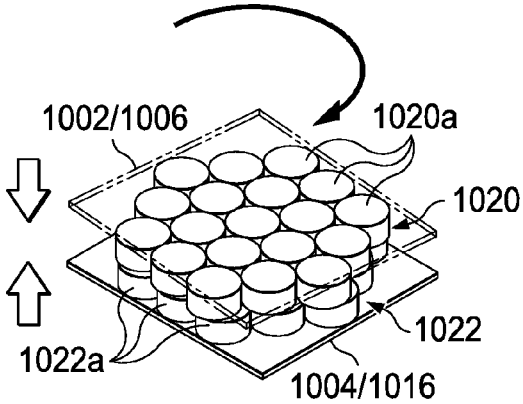
Figure 11C:
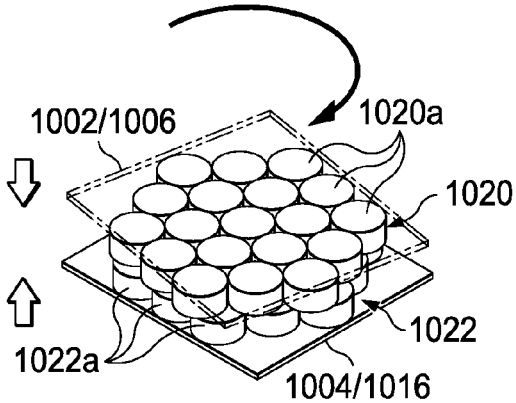
Figure 11D:
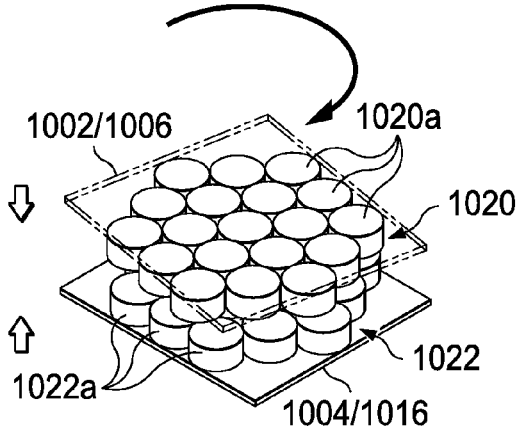
Figure 11E:
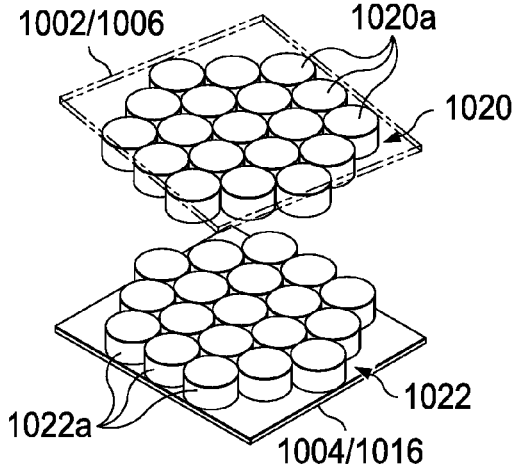
Figure 11F:
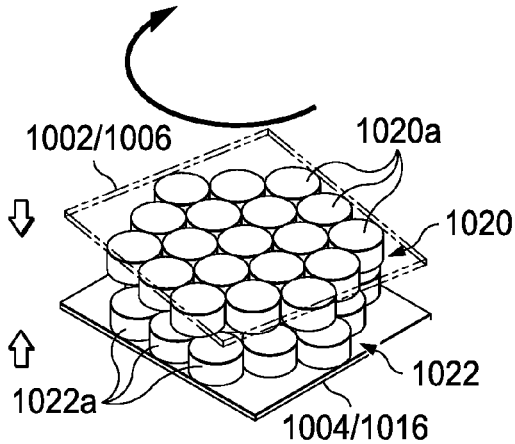
Figure 11G:
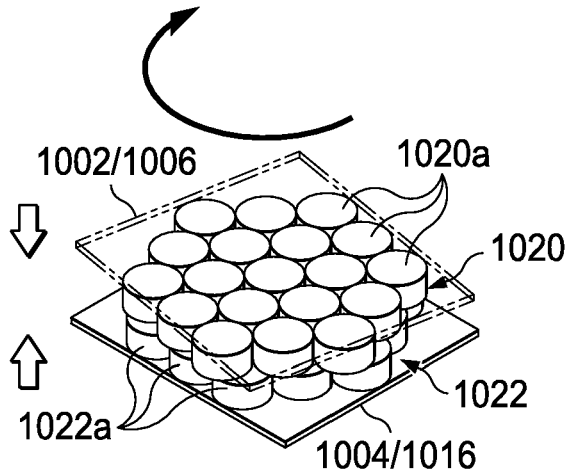
Figure 11H:
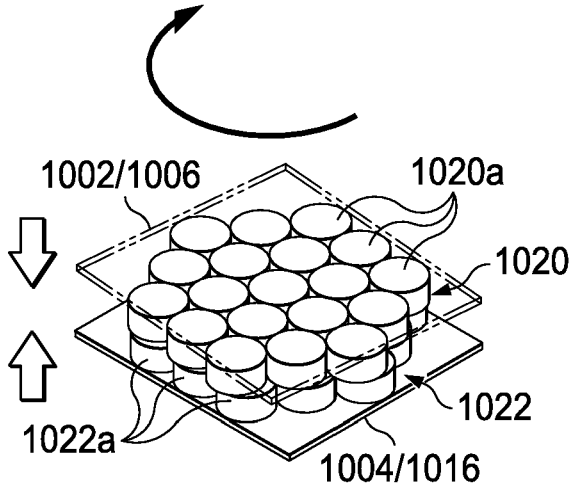
Figure 11I:
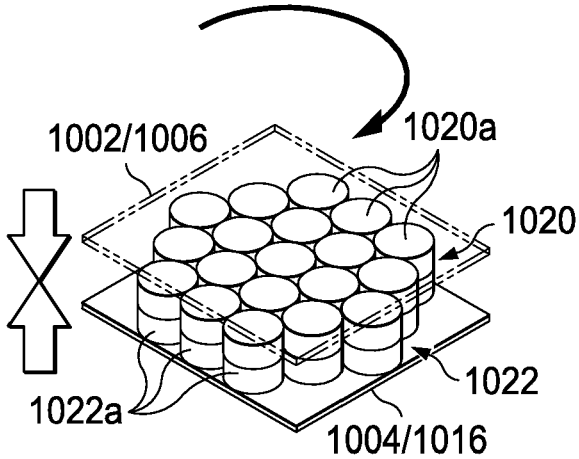

Referring to FIGS. 11A-11I, there is depicted an exemplary first magnetic field emission structure 1020 (attached to the first toy part 1002) and its mirror image second magnetic field emission structure 1022 (attached to the second toy part 1004) and the resulting spatial forces produced in accordance with their various alignments as they are twisted relative to each other which enables the user to secure or remove the first toy part 1002 to or from the second toy part 1004. In FIG. 11A, the first magnetic field emission structure 1020 and the mirror image second magnetic field emission structure 1022 are aligned producing a peak spatial force. In FIG. 11B, the first magnetic field emission structure 1020 is rotated clockwise slightly relative to the mirror image second magnetic field emission structure 1022 and the attractive force reduces significantly. To accomplish this, the user would normally grab and turn the first toy part 1002 (or second toy part 1004) relative to the second toy part 1004 (or first toy part 1002) to rotate the first magnetic field emission structure 1020 relative to the mirror image second magnetic field emission structure 1022. In FIG. 11C, the first magnetic field emission structure 1020 is further rotated and the attractive force continues to decrease. In FIG. 11D, the first magnetic field emission structure 1020 is still further rotated until the attractive force becomes very small, such that the two magnetic field emission structures 1020 and 1022 are easily separated as shown in FIG. 11E. Given the two magnetic field emission structures 1020 and 1022 held somewhat apart as in FIG. 11E, the two magnetic field emission structures 1020 and 1022 can be moved closer and rotated towards alignment producing a small spatial force as in FIG. 11F. The spatial force increases as the two magnetic field emission structures 1020 and 1022 become more and more aligned in FIGS. 11G and 11H and a peak spatial force is achieved when aligned as in FIG. 11I. In this example, the second magnetic field emission structure 1022 is the mirror of the first magnetic field emission structure 1020 resulting in an attractive peak spatial force (see also FIGS. 3-4). It should be noted that the direction of rotation was arbitrarily chosen and may be varied depending on the code employed. Plus, it should be noted that the first toy part 1002 and the second toy part 1004 can also be detached by applying a pull force, shear force, or any other force sufficient to overcome the attractive peak spatial force between the substantially aligned first and second field emission structures 1020 and 1022.

In operation, the user could pick-up the first toy part 1002 which incorporates the first magnetic field emission structure 1020. The user would then move the first toy part 1002 towards the second toy part 1004 which incorporates the second magnetic field emission structure 1022. Then, the user would align the first toy part 1002 with the second toy part 1004 such that the first toy part 1002 can be attached to the second toy part 1004 when the first and second magnetic field emission structures 1020 and 1022 are located next to one another and have a certain alignment with respect to one another where they correlate with each other to produce a peak attractive force. The user can release the first toy part 1002 from the second toy part 1004 by turning the first magnetic field emission structure 1020 relative to the second magnetic field emission structure 1022 so as to misalign the two field emission structures 1020 and 1022. This process for attaching and detaching the two toy parts 1002 and 1004 is possible because each of the first and second magnetic field emission structures 1020 and 1022 includes an array of field emission sources 1020*a* and 1022*a* each having positions and polarities relating to a desired spatial force function that corresponds to a relative alignment of the first and second magnetic field emission structures 1020 and 1022 within a field domain. Each field emission source of each array of field emission sources 1020*a* and 1022*a* has a corresponding field emission amplitude and vector direction determined in accordance with the desired spatial force function, where a separation distance between the first and second magnetic field emission structures 1020 and 1022 and the relative alignment of the first and second magnetic field emission structures 1020 and 1022 creates a spatial force in accordance with the desired spatial force function. The field domain corresponds to first field emissions from the array of first field emission sources 1020*a* of the first magnetic field emission structure 1020 interacting with second field emissions from the array of second field emission sources 1022*a* of the second magnetic field emission structure 1022.

The toy parts 1002 and 1004 described above have walls that could alternatively be referred to as being surfaces of the toy part, sides of the toy part, or faces of the toy part. In fact, the first toy part 1002 and the second toy part 1004 can be any desired shape such as, for example, a cylindrical shape, a circular shape, a spherical shape, a jagged shape, etc. Moreover, the shapes of the first toy part 1002 and the second toy part 1004 may resemble recognizable objects (or parts of objects) such as a cabin or logs making up a log cabin; a doll or arms, legs, torso, etc. that can become a doll; a wall or bricks that can become a wall; animals; buildings; vehicles; wheels; roofs; walls; doors; windows; robots; dinosaurs; people; trees; bushes; mountains; trains; planes; rockets; military equipment; soldiers; policeman, fireman; bridges; dams; traffic light systems; fire hydrants; etc. For example, the first toy part 1002 may be the fuselage of a toy plane, the second toy part 1004 may be a wing of the toy plane, and other toy parts may make up the remainder of the toy plane such that the toy plane can be assembled from the various toy parts (see FIGS. 13 and 14). As such, the present invention enables a new form of model planes, model ships, model villages, model towns, model battlefields, etc. Moreover, the field emission structures can be placed onto or be integrated with existing toys parts (and other objects) to enable precision attachment to other toy parts and to surfaces. For example, a doll collection could be displayed whereby (perhaps standing) dolls (with a field emission structure) would be secured to a surface (with a field emission structure) but these dolls could be easily removed by turning the doll (or the surface). Generally, the present invention can be used to produce all sorts of toys comprising multiple parts of various sizes and shapes as described later below with respect to FIGS. 13 and 14.

Referring to FIGS. 12A-12B, there are diagrams of an exemplary toy 1200 which includes a first correlated magnetic toy part 1202 (shaped like a letter "T") and a second correlated magnetic toy part 1204 (shaped like a game board) in accordance with an embodiment of the present invention. In this example, the first toy part 1202 is shaped like the letter "T" but could be any letter in the alphabet or any number "0"-"9" (for example) or any desired shape. The second toy part 1204 is shaped like a game board with a predetermined location such as, for example, a "T" shadow 1205 to which the first toy part 1202 can be substantially aligned and attached. The toy 1200 could be a pre-school toy that is used as a teaching aid to teach a young child.

The first toy part 1202 has incorporated therein the first field emission structure 1220 (more possible) (see FIG. 12A). The second toy part 1204 has incorporated therein the second field emission structure 1222 (more possible) (see FIG. 12A). The first magnetic field emission structure 1220 is configured to interact with the second magnetic field emission structure 1222 such that the first toy part 1202 can, when desired, be attached (secured) to or removed from the second toy part 1204. In particular, the first toy part 1202 can be attached to the second toy part 1204 when their respective first and second magnetic field emission structures 1220 and 1222 are located next to one another and have a certain alignment with respect to one another (see FIG. 12B). Under one arrangement, the first toy part 1202 is attached to the second toy part 1204 with a desired strength to prevent the first toy part 1202 from being inadvertently disengaged from the second toy part 1204. The first toy part 1202 can be released from the second toy part 1204 when their respective first and second magnetic field emission structures 1220 and 1222 are turned with respect to one another. In addition, the first toy part 1202 and the second toy part 1204 can also be separated by applying a pull force, shear force, or other force sufficient to overcome the attractive peak spatial force between the two field emission structures 1220 and 1222.

This process for attaching and detaching the two toy parts 1202 and 1204 is possible because the first and second magnetic field emission structures 1220 and 1222 each comprise an array of field emission sources 1220*a* and 1222*a* (e.g., an array of magnets 1220*a* and 1222*a*) each having positions and polarities relating to a desired spatial force function that corresponds to a relative alignment of the first and second magnetic field emission structures 1220 and 1222 within a field domain (see discussion about correlated magnet technology). In particular, each field emission source of each array of field emission sources 1220*a* and 1222*a* has a corresponding field emission amplitude and vector direction determined in accordance with the desired spatial force function, where a separation distance between the first and second magnetic field emission structures 1220 and 1222 and the relative alignment of the first and second magnetic field emission structures 1220 and 1222 creates a spatial force in accordance the desired spatial force function. The field domain corresponds to first field emissions from the array of first field emission sources 1220*a* of the first magnetic field emission structure 1220 interacting with second field emissions from the array of second field emission sources 1222*a* of the second magnetic field emission structure 1222. The first toy part 1202 can be attached (secured) to or removed from the second toy part 1204 in the same manner as was discussed above with respect to FIGS. 11A-11I or by applying a pull force, shear force, or other force sufficient to overcome the attractive peak spatial force.

Because the toy parts 1202 and 1204 can be attached using correlated magnetics then, as long as the attractive peak spatial force is greater than the gravitational forces, the two toy parts 1202 and 1204 can have any orientation including the game board 1204 being oriented such that the first toy part 1202 is 'upside down' when attached to the second toy part 1204. Generally, the present invention enables all sorts of new types of toys whereby alignment of toy parts can have strong magnetic fields that overcome gravitational and other forces, such that toy parts can hang from a ceiling or attach to a wall.

For instance, a child can produce a bridge using correlated magnetic toy parts (bricks) that will maintain their alignment and attachment, whereas conventional brick-like toys would succumb to gravity and fail apart. One skilled in the art will also recognize that toys based on non-correlated magnetism (or dumb magnets) do not have the same characteristics as those based on correlated magnetism (or smart magnets). Without, correlation, the dumb magnets will not by themselves precisely align. Moreover, such dumb magnets do not have the ability to de-correlate when misaligned so that field emissions will cancel each other. As such, the dumb magnets cannot be too strong because if they are then the associated toy parts could not be easily detached from one another.

If desired, the second toy 1204 can also be implemented using an array of electromagnets such that the second field emission structure 1222 can be caused to move by changing states of electromagnets (as has been previously described in detail). As such, a first field emission structure 1020 of a first toy 1202 can be aligned with and attached to the second field emission structure 1222 so that when the second field emission structure 1222 is moved electronically by changing states of electromagnets then the first toy 1202 can be made to move on the game board 1204. Under one arrangement, the second toy 1204 comprises a game board between two players of a game, for example, a chess game involving moving chess pieces (first toys 1202) or a sports game involving moving sports figures (first toys 1202). The game board could be fiat or have any desired shape and could be a vertical game board.

Figure 12C:
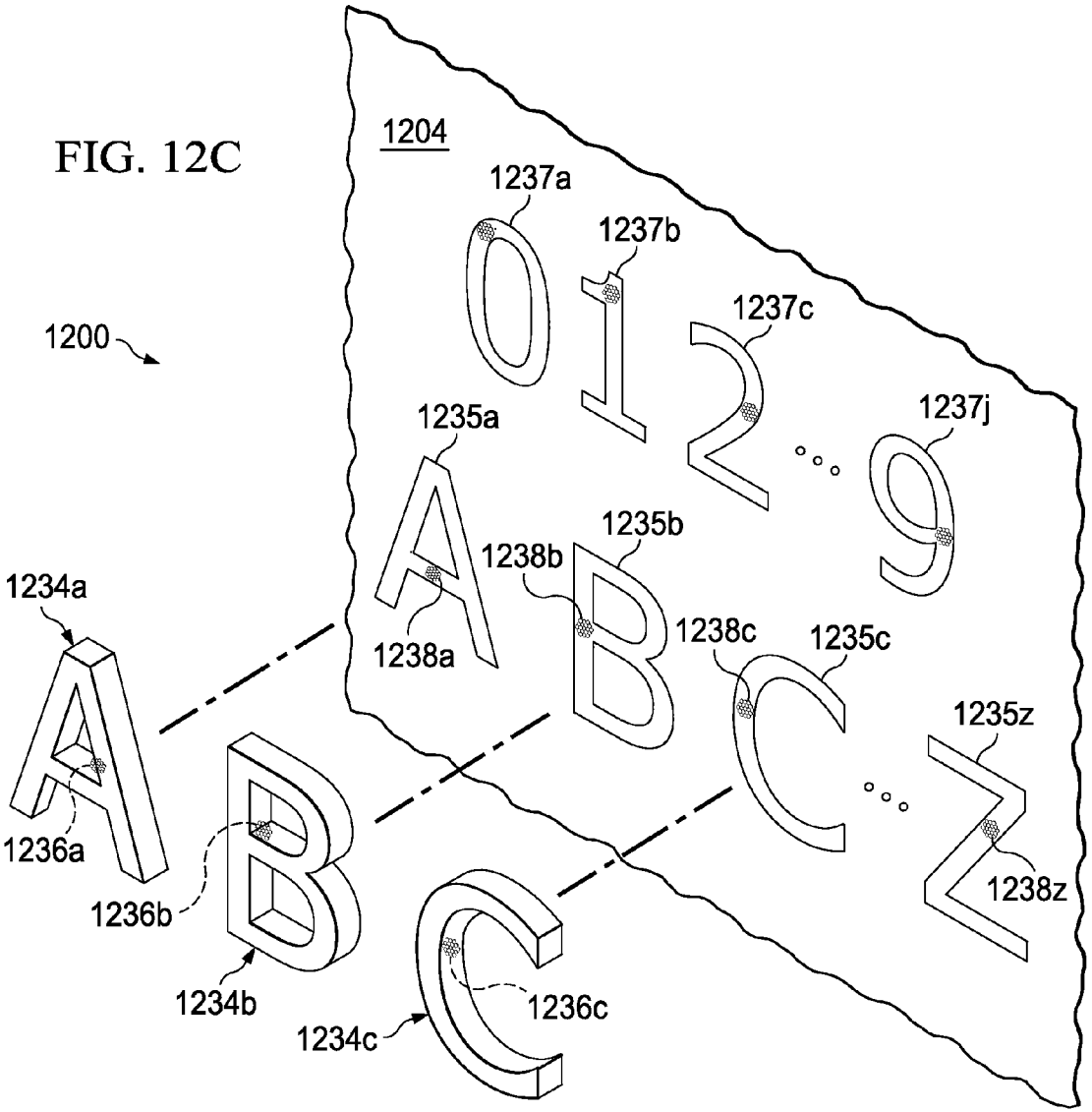

Referring now to FIG. 12C, it can be seen that the toy 1200 can include additional correlated magnetic toy parts 1234*a*, 1234*b*, and 1234*c* which in this example are shaped like letters "A", "B", and "C" but could include any number of correlated magnetic toy parts to represent all of the letters in the alphabet and possibly the numbers "0"-"9". In this example, the second toy part 1204 shaped like the game board could have predetermined locations such as "A"-"Z" shadow's 1235*a*, 1235*b*, 1235*c* . . . 1235*z* at which the corresponding shaped toy parts 1234*a*, 1234*b* and 1234*c* can be attached thereto or removed therefrom. For instance, the toy part 1234*a* shaped like "A" would be able to be substantially aligned with and attached to or misaligned and removed from the "A" shadow 1235*a* in the second toy part 1204 but would not be able to be substantially aligned with and attached to any of the "B"-"Z" shadow letters 1235*b*, 1235*c* . . . 1235*z* or to the "0"-"9" shadows 1237*a*, 1237*b*, 1237*c* . . . 1237*j* in the second toy part 1204 because their associated field emission structures 1236*a*, 1236*b*, 1236*c* and 1238*a*, 1238*b*, 1238*c* would be coded differently. Alternatively, the various field emission structures 1236*a*, 1236*b*, 1236*c* and 1238*a*, 1238*b*, 1238*c* could be coded the same but be oriented differently (e.g., rotated differently, configured differently) on the various toy parts so that they would themselves align and attach but the first toy parts 1202 would not appear to correctly lie within the "B"-"Z" letter shadows 1235*b*, 1235*c* . . . 1235*z* or to the "0"-"9" shadows 1237*a*, 1237*b*, 1237*c* . . . 1237*j* which represent the correct alignment (i.e., a correct symbol match) in the second toy part 1204. It should be noted that differently coded field emission structures may attach to one another due to attractive side lobe forces but they typically will not substantially align and attach as will two toy parts that are configured and intended to correlate when substantially aligned with one another.

Under one arrangement, the toy parts 1234*a*, 1234*b* and 1234*c* would have respectively incorporated therein a unique first magnetic field emission structure 1236*a*, 1236*b* and 1236*c* which is configured to interact with a respective mirror image second magnetic field emission structure 1238*a*, 1238*b* and 1238*c* associated with the second toy part 1204. In this case, each pair of magnetic field emission structures 1236*a*-1.238*a*, 1236*b*-1238*b* and 1236*c*-1238*c* would be configured and/or coded differently than the other pairs of magnetic field emission structures 1236*a*-1238*a*, 1236*b*-1238*b* and 1236*c*-1238*c*. In this way, the first magnetic field emission structure 1236*a* in the "A" shaped toy part 1202 will not substantially align with and attach to the magnetic field emission structures 1238*b*, 1238*c* . . . 1238*z* within the "B"-"Z" shaped shadows 1235*b*, 1235*c* . . . 1235*z* in the second toy part 1204. This is desirable since the first toy parts 1234*a*, 1234*b* and 1246*c* can only be correctly secured to desired locations on the second toy part 1204, which is a useful tool for teaching young children. Alternatively, the first toy parts 1236*a*, 1236*b* and 1236*c* can be any desired shape such as different animals, different houses, different vehicles, different airplanes, different boats etc., while the second toy part 1204 is a game board with spaces marked having the corresponding mirror image second magnetic field emission structures 1238*a*, 1238*b* and 1238*c*, which receive the respective first toy parts 1236*a*, 1236*b* and 1236*c*.

Figure 13A:
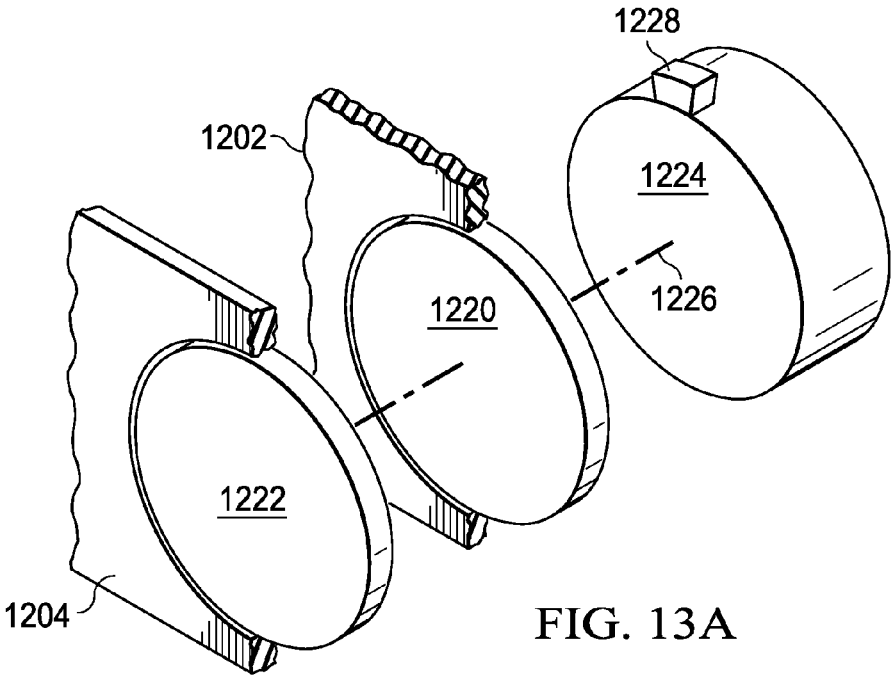
FIGS. 13A-13C illustrate several diagrams of an exemplary release mechanism that can be incorporated within one or more of the correlated magnetic toy parts (shaped like letter(s), number(s), animal(s), etc.) shown in FIGS. 12A-12C in accordance with an embodiment of the present invention.
Figure 13B:
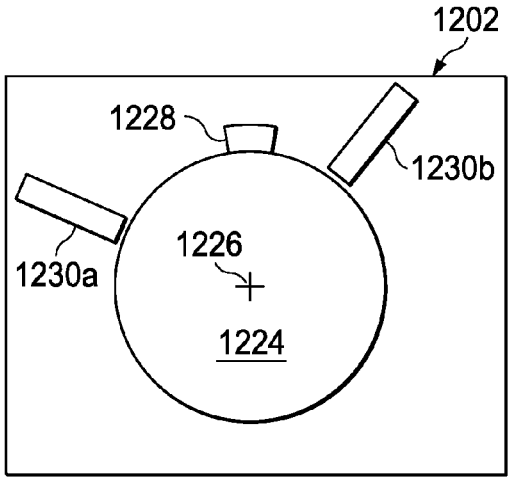
Figure 13C:
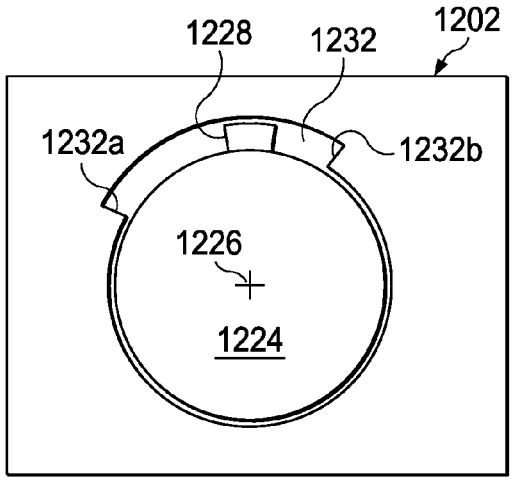

In addition, any one or all of the first toy parts 1202, 1234*a*, 1234*b* and 1234*c* can, if desired, have a release mechanism 1224 (e.g., turn-knob 1224) which is used to turn the first magnetic field emission structure 1220, 1236*a*, 1236*b* and 1236*c* relative to the mirror image second magnetic field emission structure 1222, 1238*a*, 1238*b* and 1238*c* such that the first toy parts 1202, 1234*a*, 1234*b* and 1234*c* can be attached (secured) to or removed from the second toy part 1204. FIGS. 13A-13C are several diagrams that illustrate an exemplary release mechanism 1224 (e.g., turn-knob 1224) attached to toy part 1202 (for example) in accordance with an embodiment of the present invention. In FIG. 13A, a portion of the first toy part 1202 which has the first magnetic field emission structure 1220 is shown along with a portion of the second toy part 1204 having the second magnetic field emission structure 1222. The release mechanism 1224 is physically secured to the first magnetic field emission structure 1220. The release mechanism 1224 and the first magnetic field emission structure 1220 are also configured to turn about axis 1226 allowing them to rotate such that the first magnetic field emission structure 1220 can be attached to and separated from the second magnetic field emission structure 1222. Typically, the release mechanism 1224 and the first magnetic field emission structure 1220 would be turned by the user's hand. The release mechanism 1224 can also include at least one tab 1228 which is used to stop the movement of the first magnetic field emission structure 1220 within the first toy part 1204 relative to the second magnetic field emission structure 1222. In FIG. 13B, there is depicted a general concept of using the tab 1228 to limit the movement of the first magnetic field emission structure 1220 between two travel limiters 1230*a* and 1230*b* which protrude up from the first toy part 1202. The two travel limiters 1230*a* and 1230*b* might be any fixed object placed at desired locations on the first toy part 1202 where for instance they limit the turning radius of the release mechanism 1224 and the first magnetic field emission structure 1220. FIG. 13C depicts an alternative approach where the first toy part 1202 has a travel channel 1232 formed therein that is configured to enable the release mechanism 1224 (with the tab 1228) and the first magnetic field emission structure 1220 to turn about the axis 1226 where the travel limiters 1232*a* and 1232*b* limit the turning radius. For example, when the tab 1228 is stopped by travel limiter 1232*a* (or travel limiter 1230*a*) then the first toy part 1202 can be separated from the second toy part 1204, and when the tab

1228 is stopped by travel limiter 1232*b* (or travel limiter 1230*b*) then the first toy part 1202 is secured to the second toy part 1204.

Figure 14A:
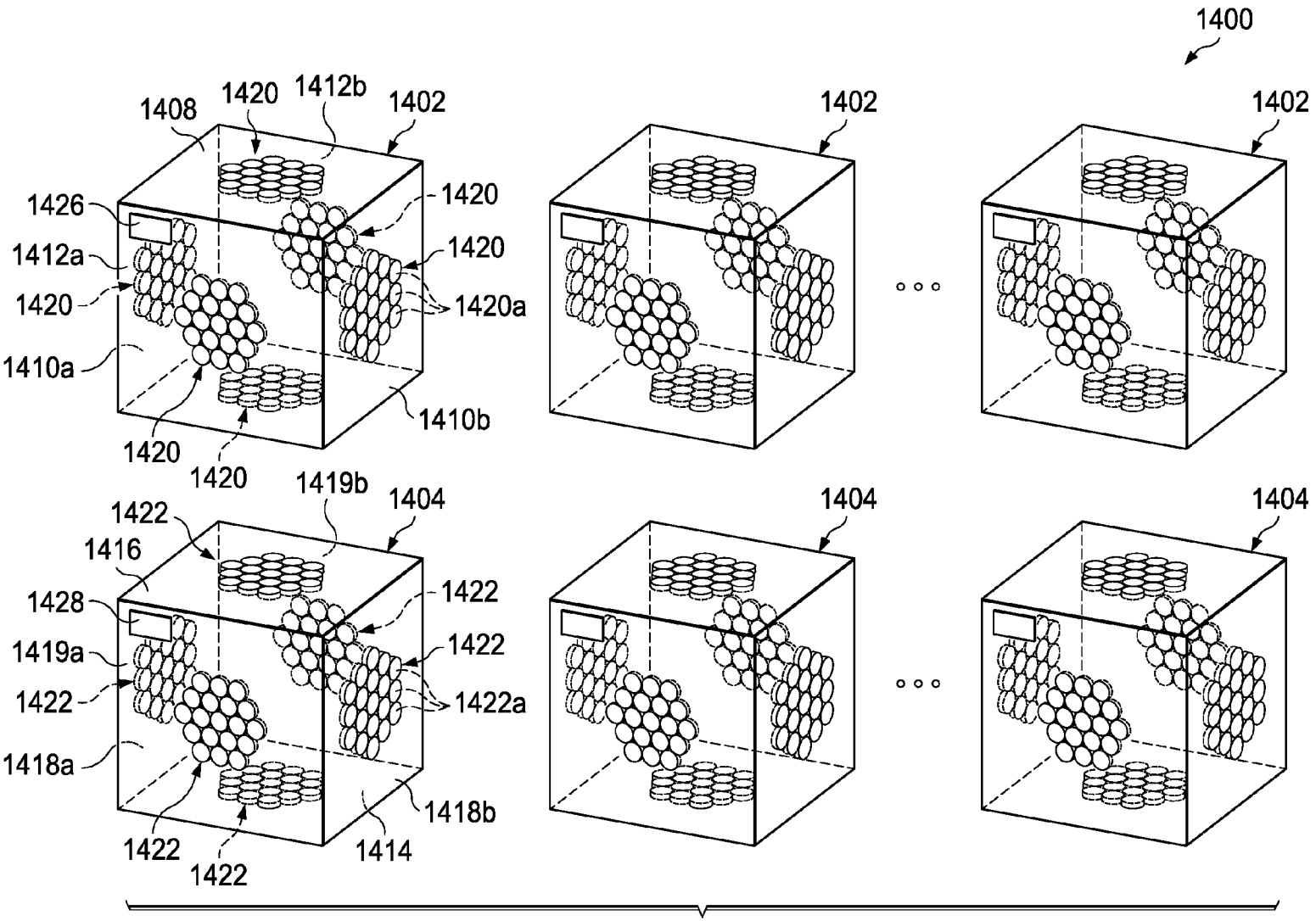
FIGS. 14A-14C are diagrams of an exemplary toy that includes multiple correlated magnetic toy parts that can be attached to one another to form an abstract combination in accordance with an embodiment of the present invention.
Figure 14B:
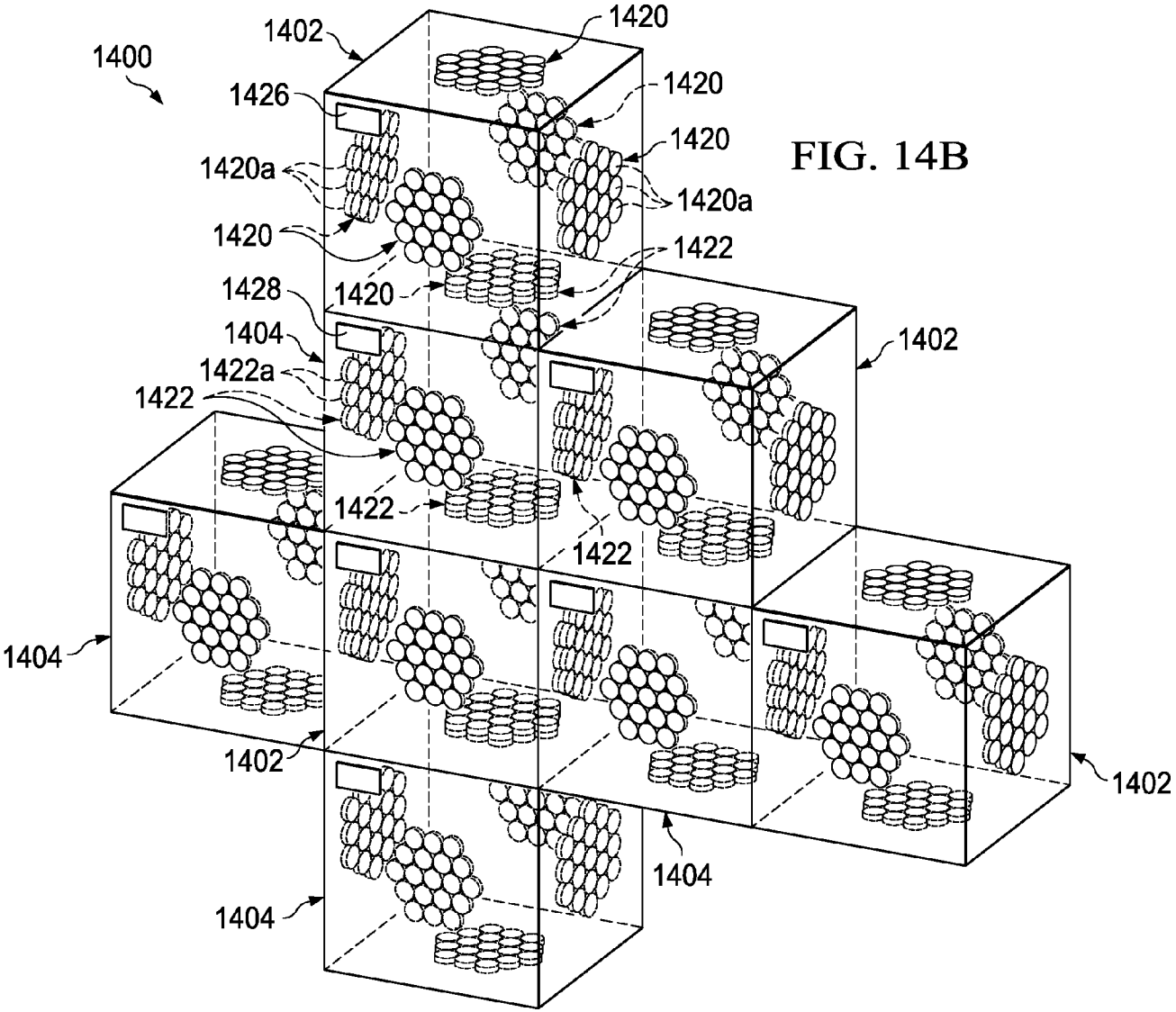

Referring to FIGS. 14A-14B, there are diagrams of an exemplary toy 1400 that includes multiple correlated magnetic first toy parts 1402 and multiple correlated magnetic second toy parts 1404 that can be attached to one another to form any desired abstract shape in accordance with an embodiment of the present invention. In this example, the first toy parts 1402 (first toy building elements 1402) are shaped like blocks where each block has a bottom wall 1406, a top wall 1408, opposite side walls 1410*a* and 1410*b*, and opposite end walls 1412*a* and 1412*b*. Likewise, the second toy parts 1404 (second toy building elements 1404) are shaped like blocks where each block has a bottom wall 1414, a top wall 1416, opposite side walls 1418*a* and 1418*b*, and opposite end walls 1419*a* and 1419*b*. Alternatively, the first toy part 1402 and the second toy part 1404 can be any desired shape such as, for example, a donut shape, an arch, a pyramid shape, a hexagonal shape, etc.

Each first toy part 1402 has a first field emission structure 1420 incorporated within one or more of the walls 1406, 1408, 1410*a*, 1410*b*, 1412*a* and 1412*b* (see FIG. 14A). Each second toy part 1404 has a mirror image second field emission structures 1422 incorporated within one or more of the walls 1414, 1416, 1418*a*, 1418*b*, 1419*a* and 1419*b* (see FIG. 14A). The first magnetic field emission structures 1420 are configured to interact with the second magnetic field emission structures 1422 such that any one of the first toy parts 1402 can, when desired, be attached (secured) to or removed from any one of the second toy parts 1404. In particular, each first toy part 1402 can be attached to each second toy part 1404 when one of their respective first and second magnetic field emission structures 1420 and 1422 are located next to one another and have a certain alignment with respect to one another (see FIG. 14B). Under one arrangement, each first toy part 1402 is attached to each second toy part 1404 with a desired strength to prevent the first toy part 1402 from being inadvertently disengaged from the second toy part 1404. Each first toy part 1402 can be released from each second toy part 1404 when their respective paired first and second magnetic field emission structures 1420 and 1022 are turned with respect to one another (see FIG. 14A). This process of attaching and detaching toy parts 1402 and 1404 is possible because the first and second magnetic field emission structures 1420 and 1422 each comprise an array of field emission sources 1420*a* and 1422*a* (e.g., an array of magnets 1420*a* and 1422*a*) each having positions and polarities relating to a desired spatial force function that corresponds to a relative alignment of the first and second magnetic field emission structures 1420 and 1422 within a field domain (see discussion about correlated magnet technology). The first toy parts 1402 can be attached (secured) to or removed from the second toy parts 1404 in the same manner as was discussed above with respect to FIGS. 11A-11I. Plus, it should be noted that the first toy part 1402 and the second toy part 1404 can also be detached by applying a pull force, shear force, or any other force sufficient to overcome the attractive peak spatial force between the substantially aligned first and second field emission structures 1420 and 1422.

In operation, the user could pick-up one of the first toy parts 1402 which incorporates the first magnetic field emission structures 1420. If desired, the first toy parts 1402 may have an identifier 1426 such as a number, color or symbol to identify the first magnetic field emission structures 1420 and to distinguish the first magnetic field emission structures 1420 from the second magnetic field emission structures 1422. The user would then move the selected first toy part 1402 towards any one of the second toy parts 1404 which incorporates the second magnetic field emission structures 1422. If desired, the second toy parts 1404 may have an identifier 1428 such as a number, color or symbol to identify the second magnetic field emission structures 1422 and to distinguish the second magnetic field emission structures 1422 from the first magnetic field emission structures 1420. Then, the user would align the first toy part 1402 with the second toy part 1404 such that the first toy part 1402 can be attached to the second toy part 1404 when a pair of the first and second magnetic field emission structures 1420 and 1422 are located next to one another and have a certain alignment with respect to one another. The user can repeat this process to attach as many of the first and second toy parts 1402 and 1404 to one another in any desired abstract combination (see FIG. 14B). The user can release any one of the first toy parts 1402 from any one of the second toy parts 1404 by turning their respective first magnetic field emission structure 1420 relative to the second magnetic field emission structure 1422. This process of attaching and detaching toy parts 1402 and 1404 is possible because each of the first and second magnetic field emission structures 1420 and 1422 includes an array of field emission sources 1420*a* and 1422*a* each having positions and polarities relating to a desired spatial force function that corresponds to a relative alignment of the first and second magnetic field emission structures 1420 and 1422 within a field domain. Each field emission source of each array of field emission sources 1420*a* and 1422*a* has a corresponding field emission amplitude and vector direction determined in accordance with the desired spatial force function, where a separation distance between the first and second magnetic field emission structures 1420 and 1422 and the relative alignment of the first and second magnetic field emission structures 1420 and 1422 creates a spatial force in accordance with the desired spatial force function. The field domain corresponds to first field emissions from the array of first field emission sources 1420*a* of the first magnetic field emission structure 1420 interacting with second field emissions from the array of second field emission sources 1422*a* of the second magnetic field emission structure 1422.

Figure 14C:
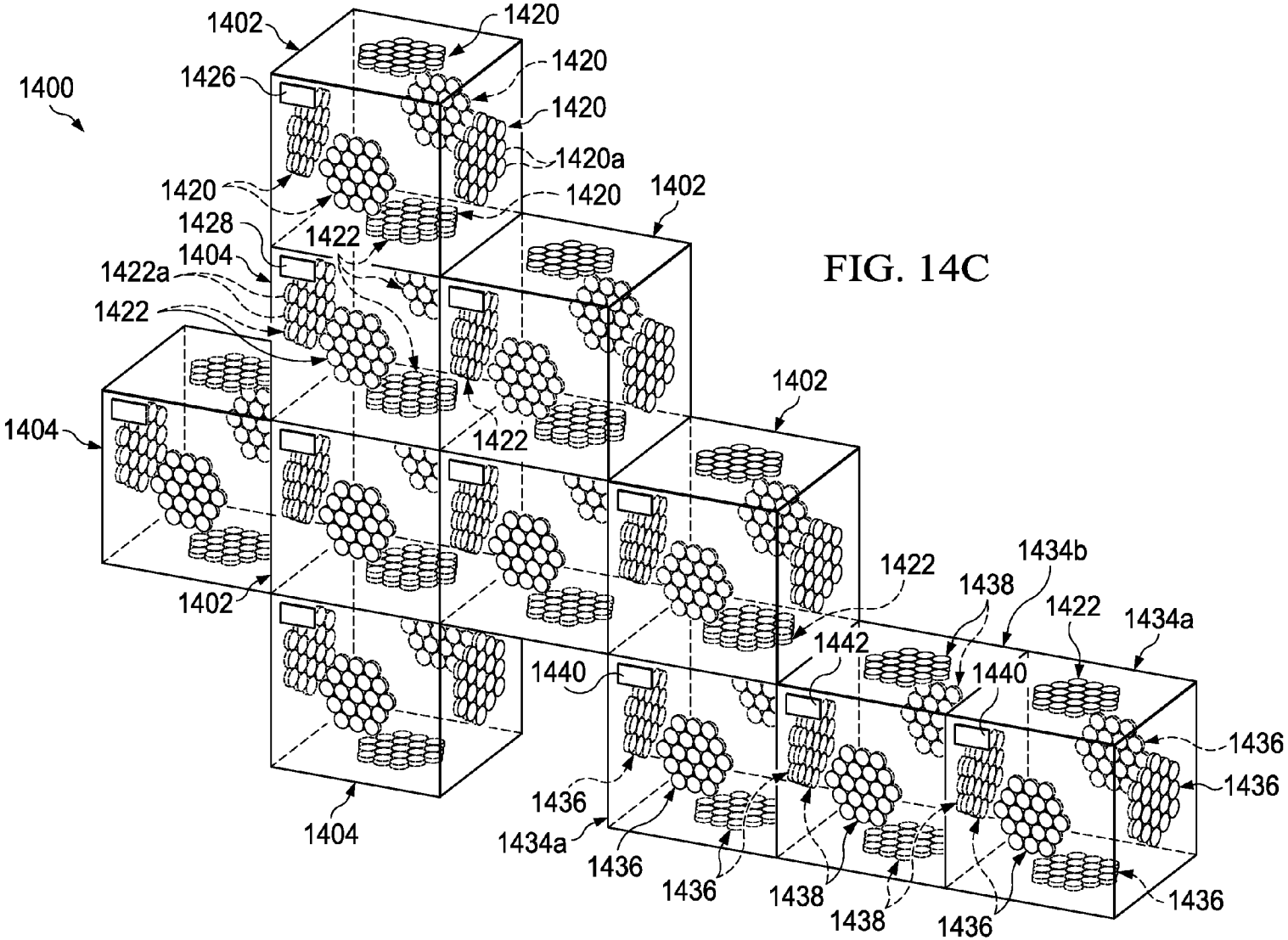

Referring to FIG. 14C, it can be seen that the toy 1400 can include additional correlated magnetic toy parts 1434*a* and 1434*b* (more possible) which are shaped like blocks but could be any shape, as has been previously described. In this example, the first additional toy parts 1434*a* (only two shown) have incorporated within at least one wall a mirror image second field emission structure 1422 and within at least another wall a third field emission structure 1436. The second additional toy part 1434*b* (only one shown) has incorporated within at least one wall a fourth field emission structure 1438 that is a mirror image of the third field emission structure 1436. The third and fourth magnetic field emission structures 1436 and 1438 would be configured and/or coded differently than the first and second magnetic field emission structures 1420 and 1422 such that the third and fourth magnetic field emission structures 1436 and 1438 will not substantially align with and interact with the first and second magnetic field emission structures 1420 and 1422. If desired, the third and fourth magnetic field emission structures 1436 and 1438 may each have their own identifier 1440 and 1442 such as a number, color or symbol to distinguish them from one another and to distinguish each of them from the first and second magnetic field emission structures 1420 and 1422. In this example, the first additional toy parts 1434*a* can be attached to the first toy part 1402 by aligning the first and second field emission structures 1420 and 1422. Then, the second additional toy part 1434*b* can be attached to either of the first additional toy parts 1434*a* by aligning the third and fourth field emission structures 1436 and 1438 and so on until a user of the correlated magnetic toy parts 1402, 1404, 1434*a* and 1434*b* obtains a desired abstract shape. In fact, there can be many different toy parts (with various field emission structures) in addition to toy parts 1402, 1404, 1434*a* and 1434*b* that can be configured so they can be attached to one another to form any desired abstract shape in accordance with an embodiment of the present invention. For example, a correlated magnetic construction kit might, include correlated magnetic toy parts shaped like bricks, walls, roofs, windows, doors, chimneys, shutters, staircases, trusses, beams, bathroom fixtures, lighting fixtures, plumbing, ductwork, etc. whereby a user can construct a predefined structure or one made up while playing with the toy (see FIG. 15A). As such, new correlated magnetic versions of well known toys such as Lego® toys, Lincoln Logs®, Tinkertoy® Construction Sets, Mr. Potato Head, and the like can be produced in accordance with the present invention.

Figure 15A:
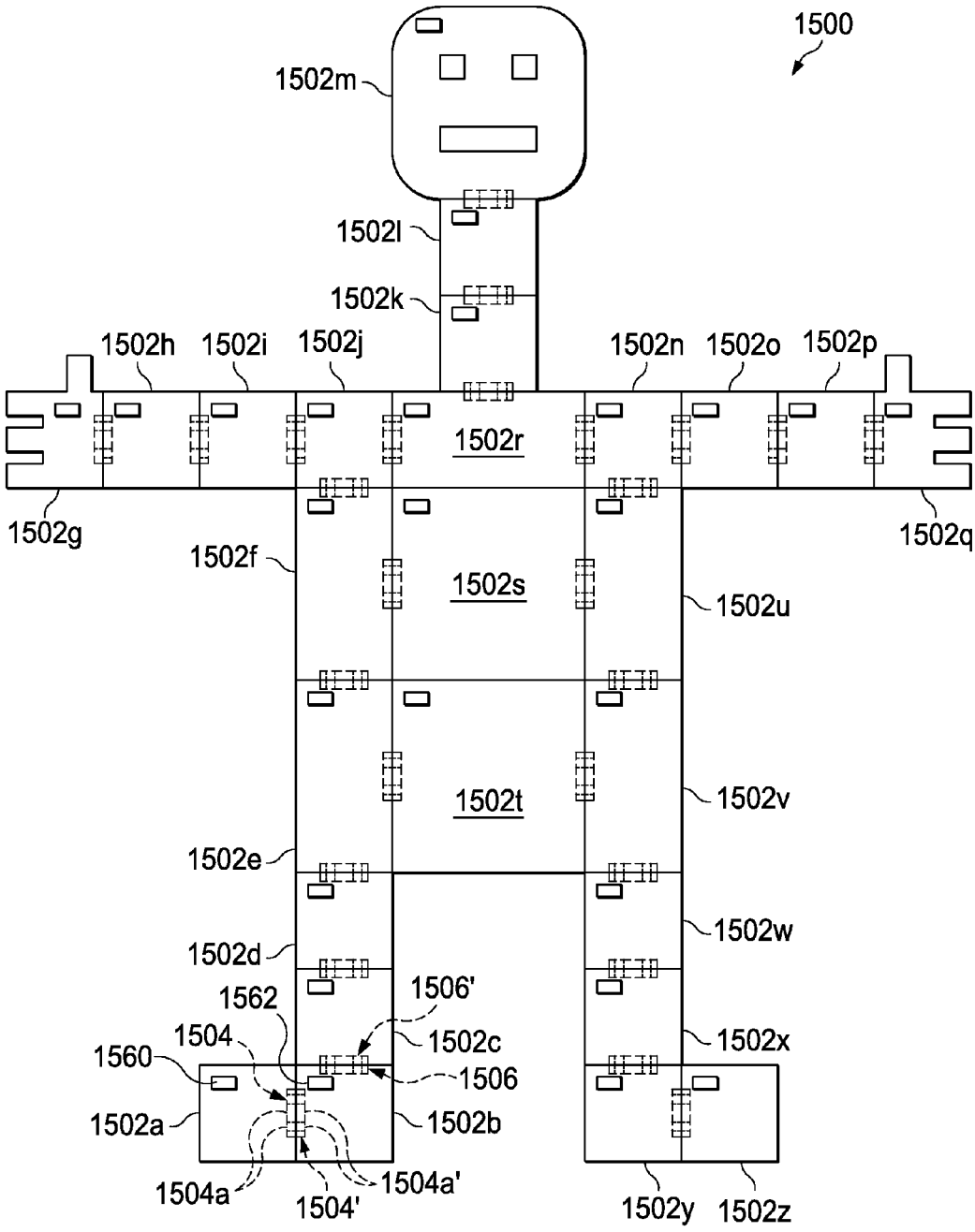
FIG. 15A is a diagram of an exemplary toy that includes multiple correlated magnetic toy parts that are attached to one another to form a predetermined shape (e.g., robot, vehicle, boat, rocket, airplane) in accordance with an embodiment of the present invention.

Referring to FIG. 15A, there is a diagram of an exemplary toy 1500 that includes multiple correlated magnetic toy parts 1502*a*, 1502*b* . . . 1502*z* that are attached to one another to form a predetermined shape (e.g., robot, vehicle, boat, rocket, airplane) in accordance with an embodiment of the present invention. In this embodiment, each toy part 1502*a*, 1502*b* . . . 1502*z* has a predetermined shape and is configured to be attached to one or more pre-selected toy parts 1502*a*, 1502*b* . . . 1502*z*. For example, toy part 1502*a* is designed to interact with and attach to only toy part 1502*b* and toy part 1502*b* is designed to interact with and attach to toy parts 1502*a* and 1502*c* and so on for the other toy parts 1502*c*, 1502*d* . . . 1502*z* such that when all of the toy parts 1502*a*, 1502*b* . . . 1502*z* are connected to one another they form a predetermined shape which in this case is a robot but can be any shape such as for example a vehicle, a boat, a rocket, or an airplane. In other words, the toy parts 1502*a*, 1502*b* . . . 1502*z* can be used to form any predetermined structure, for example, a two-dimensional structure or predetermined three-dimensional structure. Under one arrangement, the toy parts 1502*a*, 1502*b* . . . 1502*z* can represent a puzzle whereby a user must search for combinations of parts that align, which may or may not be desirable to solve the puzzle.

In one embodiment, a first toy part 1502*a* and a second toy part 1502*b* (for example) have respectively incorporated therein at least first and second field emission structures 1504 and 1504' (for example) that are configured and/or coded to be a unique mirror image pair and as such will substantially align only with one another, which allows the user to correctly attach toy parts 1502*a* and 1502*b* (for example) together but not substantially align and attach them to other toy parts 1502*c*, 1502*d* . . . 1502*z*. For instance, the first toy part 1502*a* can be substantially aligned and attached to the second toy part 1502*b* when their respective first and second magnetic field emission structures 1504 and 1504' are located next to one another and have a certain alignment with respect to one another. In this example, the first toy part 1502*a* will not substantially align and attach to other toy parts 1502*c*, 1502*d* . . . 1502*z* that have differently code magnetic field emission structures. Under one arrangement, the first toy part 1502*a* is attached to the second toy part 1502*b* with a desired strength to prevent them from being inadvertently disengaged from one another. The first toy part 1502*a* can be released from the second toy part 1502*b* when their respective first and second magnetic field emission structures 1504 and 1504' are turned with respect to one another (see FIGS. 11A-11I). Plus, first toy part 1502*a* and the second toy part 1502*b* can also be detached by applying a pull force, shear force, or any other force sufficient to overcome the attractive peak spatial force between the substantially aligned first and second field emission structures 1504 and 1504'. Likewise, the second toy part 1502*b* can be attached to a third toy part 1502*c* when their respective unique mirror image pair of third and fourth magnetic field emission structures 1506 and 1506' are located next to one another and have a certain alignment with respect to one another. Under one arrangement, the second toy part 1502*b* is attached to the third toy part 1502*c* with a desired strength to prevent them from being inadvertently disengaged from one another. The second toy part 1502*b* can be released from the third toy part 1502*c* when their respective third and fourth magnetic field emission structures 1506 and 1506' are turned with respect to one another (see FIGS. 11A-11I). Plus, second toy part 1502*b* and the third toy part 1502*c* can also be detached by applying a pull force, shear force, or any other force sufficient to overcome the attractive peak spatial force between the substantially aligned third and fourth field emission structures 1506 and 1506'. In this example, all of the toy parts 1502*a*, 1502*b* . . . 1502*c* are configured to have unique pairs of magnetic field emission structures 1504-1504' and 1506-1506' etc., which will substantially align only with each other as to enable a person to build the predetermined structure, for example, a predetermined two-dimensional structure or a predetermined three-dimensional structure.

In operation, the user would pick-up the first toy part 1502*a* which incorporates the first magnetic field emission structure 1504. If desired, the first toy part 1502*a* may have a first identifier 1560 such as a number, color or symbol to identify the first magnetic field emission structure 1504 and to distinguish the first magnetic field emission structure 1504 from the other field emission structures 1504', 1506 and 1506' etc. . . . The user would then move the selected first toy part 1502*a* towards the second toy part 1502*b*, which incorporates the second field emission structure 1504' which is a mirror image of the first field emission structure 1504. The second toy part 1502*b'* could have a second identifier 1562 such as a number, color or symbol to identify the magnetic field emission structure 1504' and to distinguish this magnetic field emission structure 1504' from the other field emission structures 1504, 1506 and 1506' etc. The two identifiers 1560 and 1562 would indicate to the user that the magnetic field emission structures 1504 and 1504' are configured to attach to one another when they are substantially aligned. Then, the user would align the first and second toy parts 1502*a* and 1502*b* such that the first toy part 1502*a* can be attached to the second toy part 1502*b* when the first and second magnetic field emission structures 1504 and 1504' are located next to one another and have a certain alignment with respect to one another. The user can repeat this process to attach toy parts 1502*b* and 1502*c* etc. . . . until all of the toy parts 1502*b*, 1502*c* . . . 1502*z* are connected in some manner so as to build the predetermined structure, for example, a predetermined two-dimensional structure or predetermined three-dimensional structure. If desired, the toy parts 1502*c*, 1502*d* . . . 1502*z* can have their own identifier(s) to help identify how they need to be connected to one another. Alternatively, the toy parts 1502*a*, 1502*b* . . . 1502*z* may have field emission structures that allow them to be connected to each other in any manner which means that it is up to the user to attached the toy parts 1502*a*, 1502*b* . . . 1502*z* in the correct manner to build the predetermined two-dimensional structure or predetermined three-dimensional structure. The user can release any pair of connected first and second toy parts 1502*a* and 1502*b* (for example) from one another by turning their respective magnetic field emission structures 1504 and 1504'. This is all possible because each pair of magnetic field emission structures 1504 and 1504' (for example) includes an array of field emission sources 1504*a* and 1504*a*' each having positions and polarities relating to a desired spatial force function that corresponds to a relative alignment of the magnetic field emission structures 1504 and 1504' within a field domain. Each field emission source of each array of field emission sources 1504*a* and 1504*a*' has a corresponding field emission amplitude and vector direction determined in accordance with the desired spatial force function, where a separation distance between the magnetic field emission structures 1504 and 1504' and the relative alignment of the magnetic field emission structures 1504 and 1504' creates a spatial force in accordance with the desired spatial force function. The field domain corresponds to first field emissions from the array of first field emission sources 1504*a* of the magnetic field emission structure 1504 interacting with second field emissions from the array of second field emission sources 1504*a*' of the magnetic field emission structure 1504'.

Although the exemplary correlated magnetic toys described herein have involved alignment of field emission structures to produce an attractive peak spatial force that attaches toy parts to each other, repellant peak spatial forces can also be used to prevent attachment of toy parts or to cause movement of toy parts. As such, movement of one toy part can result in a change reaction or subsequent movement of other toy parts, which can be precisely controlled. Likewise, attractive and repellant side lobe forces can also be used for desired purposes. For example, two toy blocks may attach strongly with one relative alignment, and they may attach with a weaker force with a second alignment, and so on. Additionally, mechanical mechanisms can define a movement path function (as previously described) of a toy part whereby its movement can cause another toy part to move. For example, a first toy part might spin about van axis causing it to anti-correlate with a second toy part once per revolution causing the second toy part to shoot pin balls out of a slot. Moreover, toy parts having different codes can be used to cause a toy to self assemble. Under one arrangement, correlated magnetic toy parts could be placed in a bowl or some other container that is shaken. Over time, the properly coded toy parts will correlate and attach to each other such that a toy (or at least a portion of a toy) self assembles. Under another arrangement, electromagnets can be controlled to produce attractive and/or repellant forces used to causes correlated magnetic toy parts to move precisely so as to self assemble a toy.

Although multiple embodiments of the present invention have been illustrated in the accompanying Drawings and described in the foregoing Detailed Description, it should be understood that the present invention is not limited to the disclosed embodiments, but is capable of numerous rearrangements, modifications and substitutions without departing from the invention as set forth and defined by the following claims. It should also be noted that the reference to the "present invention" or "invention" used herein relates to exemplary embodiments and not necessarily to every embodiment that is encompassed by the appended claims.

The invention claimed is:

1. A toy comprising:

a first toy part that incorporates a first field emission structure; and a second toy part that incorporates a second field emission structure, where the first toy part is attached to the second toy part when the first and second field emission structures are located next to one another and have a certain alignment with respect to one another, where each of the first and second field emission structures include field emission sources having positions and polarities relating to a desired spatial force function that corresponds to a relative alignment of the first and second field emission structures within a field domain, said spatial force function being in accordance with a code, said code corresponding to a code modulo of said first plurality of field emission sources and a complementary code modulo of said second plurality of field emission sources, said code defining a peak spatial force corresponding to substantial alignment of said code modulo of said first plurality of field emission sources with said complementary code modulo of said second plurality of field emission sources, said code also defining a plurality of off peak spatial forces corresponding to a plurality of different misalignments of said code modulo of said first plurality of field emission sources and said complementary code modulo of said second plurality of field emission sources, said plurality of off peak spatial forces having a largest off peak spatial force, said largest off peak spatial force being less than half of said peak spatial force.

2. The toy of claim 1, wherein the first toy part is released from the second toy part when the first and second field emission structures are turned with respect to one another.

3. The toy of claim 1, wherein the first toy part further includes a release mechanism which is used to turn the first field emission structure with respect to the second field emission structure so as to release the first toy part from the second toy part.

4. The toy of claim 1, wherein the first toy part and the second toy parts have a block shape or a log shape.

5. The toy of claim 1, wherein the first toy part has a letter shape, a car shape, a house shape, an airplane shape, a boat shape, a rocket shape or an animal shape and the second toy part is a board onto which the first toy part is attached at a desired location.

6. The toy of claim 1, further comprising one or more additional toy parts each of which has one or more field emission structures.

7. The toy of claim 6, wherein the first toy part and the second toy part each has incorporated therein one or more additional field emission structures which respectively interact with the one or more field emission structures attached to the one or more additional toy parts.

8. The toy of claim 7, wherein the first toy part, the second toy part, and the one or more additional toy parts are attached to one another to form an abstract combination by using multiple pairs of the field emission structures where each pair of field emission structures has one field emission structure and a corresponding mirror image field emission structure.

9. The toy of claim 8, wherein the one field emission structure has one identifier and the corresponding mirror image field emission structure has another identifier, where both identifiers indicate that the respective pair of field emission structures is configured to attach when properly aligned.

10. The toy of claim 7, wherein the first toy part, the second toy part, and the one or more additional toy parts are attached to one another to form a predetermined shape by using multiple pairs of the field emission structures where each pair of field emission structures has one field emission structure and a mirror image field emission structure.

11. The toy of claim 10, wherein the one field emission structure has one identifier and the corresponding mirror image field emission structure has another identifier, where both identifiers indicate that the respective pair of field emission structures is configured to attach when properly aligned.

12. The toy of claim 10, wherein the predetermined shape is a toy model including a playhouse, a doll house, a fort, a fire station, a boat, a vehicle, an animal, an airplane, a train, a robot, or a doll.

13. The toy of claim 1, wherein said positions and said polarities of each of said field emission sources are determined in accordance with at least one correlation function.

14. The toy of claim 13, wherein said at least one correlation function is in accordance with at least one code.

15. The toy of claim 14, wherein said at least one code is at least one of a pseudorandom code, a deterministic code, or a designed code.

16. The toy of claim 14, wherein said at least one code is one of a one dimensional code, a two dimensional code, a three dimensional code, or a four dimensional code.

17. The toy of claim 1, wherein each of said field emission sources has a corresponding field emission amplitude and vector direction determined in accordance with the desired spatial force function, wherein a separation distance between the first and second field emission structures and the relative alignment of the first and second field emission structures creates a spatial force in accordance with the desired spatial force function.

18. The toy of claim 17, wherein said spatial force comprises at least one of an attractive spatial force or a repellant spatial force.

19. The toy of claim 17 wherein said spatial force corresponds to a peak spatial force of said desired spatial force function when said first and second field emission structures are substantially aligned such that each field emission source of said first field emission structure substantially aligns with a corresponding field emission source of said second field emission structure.

20. The toy of claim 1, wherein said field domain corresponds to first field emissions from first field emission sources of said first field emission structure interacting with second field emissions from second field emission sources of said second field emission structure.

21. The toy of claim 1, wherein said polarities of the field emission sources comprise at least one of North-South polarities or positive-negative polarities.

22. The toy of claim 1, wherein at least one of said field emission sources comprises a magnetic field emission source or an electric field emission source.

23. The toy of claim 1, wherein at least one of said field emission sources comprises a permanent magnet, an electromagnet, an electret, a magnetized ferromagnetic material, a portion of a magnetized ferromagnetic material, a soft magnetic material, or a superconductive magnetic material.

24. A method for enabling a user to form a toy by attaching one or more toy parts to one another, said method comprising the steps of:

providing a first toy part that incorporates a first field emission structure;

providing a second toy part that incorporates a second field emission structure; and aligning the first toy part with the second toy part such that the first toy part will be attached to the second toy part when the first and second field emission structures are located next to one another and have a certain alignment with respect to one another, where each of the first and second field emission structures include field emission sources having positions and polarities relating to a desired spatial force function that corresponds to a relative alignment of the first and second field emission structures within a field domain, said spatial force function being in accordance with a code, said code corresponding to a code modulo of said first plurality of field emission sources and a complementary code modulo of said second plurality of field emission sources, said code defining a peak spatial force corresponding to substantial alignment of said code modulo of said first plurality of field emission sources with said complementary code modulo of said second plurality of field emission sources, said code also defining a plurality of off peak spatial forces corresponding to a plurality of different misalignments of said code modulo of said first plurality of field emission sources and said complementary code modulo of said second plurality of field emission sources, said plurality of off peak spatial forces having a largest off peak spatial force, said largest off peak spatial force being less than half of said peak spatial force.

25. The method of claim 24, further comprising a step of releasing the first toy part from the second toy part, where the first toy part is released from the second toy part when the first and second field emission structures are turned with respect to one another.

26. The method of claim 24 further comprising the step of providing one or more additional toy parts each of which has one or more field emission structures, wherein the first toy part and the second toy part each has incorporated therein one or more additional field emission structures which respectively interact with the one or more field emission structures attached to the one or more additional toy parts.

27. The method of claim 26, wherein the first toy part, the second toy part, and the one or more additional toy parts are attached to one another to form an abstract combination by using multiple pairs of field emission structures where each pair of field emission structures has one field emission structure and a corresponding mirror image field emission structure.

28. The toy of claim 26, wherein the first toy part, the second toy part, and the one or more additional toy parts are attached to one another to form a predetermined shape by using multiple pairs of field emission structures where each pair of field emission structures has one field emission structure and a mirror image field emission structure.

* * * * *